US005444468A

United States Patent [19]

Fukushima et al.

[11] Patent Number: 5,444,468

[45] Date of Patent: Aug. 22, 1995

[54] IMAGE FORMING APPARATUS WITH MEANS FOR CORRECTING IMAGE DENSITY UNEVENNESS

[75] Inventors: Hisashi Fukushima; Haruhiko Moriguchi; Nobuhiko Takekoshi, all of Yokohama, Japan

[73] Assignee: Canon Kabushiki Kaisha, Tokyo, Japan

[21] Appl. No.: 799,157

[22] Filed: Nov. 27, 1991

[30] Foreign Application Priority Data

Nov. 29, 1990 [JP] Japan ..... 2-326018

[51] Int. Cl.[6] ..... B41J 2/01; B41J 2/44

[52] U.S. Cl. ..... 347/14; 347/248

[58] Field of Search ..... 346/140 R, 134, 136, 346/160, 110 R, 138, 154; 400/582, 583.4, 279; 395/105; 358/298, 300, 302; 347/14, 37, 101, 104

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,445,128 | 4/1984 | Dolan et al. | 346/160 |
| 4,459,600 | 7/1984 | Sato et al. | 346/140 R |
| 4,463,359 | 7/1984 | Ayata et al. | 346/1.1 |
| 4,475,115 | 10/1984 | Garbe et al. | 346/160 X |
| 4,525,729 | 6/1985 | Agulnek et al. | 346/107 R X |
| 4,541,711 | 9/1985 | Takahashi | 346/160 X |
| 4,558,333 | 12/1985 | Sugitani et al. | 346/140 R |
| 4,575,739 | 3/1986 | DeSchamphelaere et al. | 346/160 |
| 4,596,995 | 6/1986 | Yamakawa et al. | 346/160 |
| 4,639,735 | 1/1987 | Yamamoto et al. | 346/140 R X |
| 4,670,761 | 6/1987 | Yoshino et al. | 346/138 X |
| 4,723,129 | 2/1988 | Endo et al. | 346/1.1 |
| 4,740,796 | 4/1988 | Endo et al. | 346/1.1 |
| 4,835,545 | 5/1989 | Mager et al. | 346/160 X |
| 4,963,989 | 10/1990 | Morton | 358/298 |
| 4,983,994 | 1/1991 | Mori et al. | 346/76 PH |
| 5,111,242 | 5/1992 | Tanimoto et al. | 346/160 X |
| 5,136,307 | 8/1992 | Uchida et al. | 346/136 |
| 5,140,340 | 8/1992 | Stephenson | 346/136 X |

FOREIGN PATENT DOCUMENTS

| | | |
|---|---|---|
| 54-056847 | 5/1979 | Japan . |
| 54-097026 | 7/1979 | Japan . |
| 59-123670 | 7/1984 | Japan . |
| 59-138461 | 8/1984 | Japan . |
| 60-071260 | 4/1985 | Japan . |
| 0132473 | 5/1990 | Japan . |

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

An image forming apparatus such as a laser beam printer or an ink-jet recording apparatus has a recording head which records an image on a recording medium in the direction of main scan in accordance with image signals. The recoding medium is moved relative to the recording head in a sub-scan direction substantially perpendicular to the direction of the main scan. A controller controls conditions of recording performed by the recording head so as to effect a correction of recording density unevenness cause by a variation of the relative speed of movements of parts of the apparatus.

42 Claims, 19 Drawing Sheets

I

II

III

P GND
B64
B2
B1
385
387
384
314
313
315
317
316
318
CNT B
CNT A
4
3
7
311
310
312
388
OUTPUT PROTECT CIRCUIT
STBI
EO
EI
EcK
BEI
CCKI
SEL1I
SEL2I
LATI
D16
D1Ø
ScKI
VDD
LGND
Do6
DOØ

IMAGE FORMING APPARATUS WITH MEANS FOR CORRECTING IMAGE DENSITY UNEVENNESS

BACKGROUND OF THE INVENTION

1. Field of the Invention

The present invention relates to an image forming apparatus which controls recording conditions in accordance with any unevenness in the recording quality thereby forming an image of a uniform quality.

2. Description of the Related Art

Hitherto, various mechanical methods have been proposed for correcting any unevenness of recording quality. For instance, a method has been proposed in which the speed at which a recording paper is fed is varied in accordance with a change in the amount of eccentricity of the drive roller. In another known method, a roller is used which presses a paper feed belt and a drive roller to each other. These mechanical means, however, are still unsatisfactory in that they cannot eliminate unevenness of recording density to an acceptable level, due to a limit in the precision of mechanical processing and assembly of the parts.

Meanwhile, in the field of printing using a multi-nozzle ink jet head or a thermal head, it has been proposed to correct unevenness of printing quality attributable to fluctuation in the properties of printing heads by suitably controlling the level of image signals and/or printing conditions.

This proposed method, however, is effective only in the correction of unevenness of recording quality occurring in the direction of the main scan.

In some cases, however, unevenness regularly occurs on the recording medium due to various reasons such as eccentricity of a paper feed roller, expansion or contraction of a paper feed belt, oscillation of an optical system, e.g., a back scan by a light source of an image reader, caused by movements of parts around the recording region, and so forth. Such regular unevenness takes place also when the feeding speed of the recording paper is changed, e.g., when the leading end of a sheet of recording paper is caught in a fixing device while the central portion of the sheet is still under printing. Such regular unevenness in the recording quality is preferably eliminated by mechanical means. Actually, however, such mechanical correcting means inevitably causes unevenness in the sub-scan direction. Hitherto, no measures have been proposed for eliminating such unevenness of recording quality occurring in the sub-scan direction.

SUMMARY OF THE INVENTION

Accordingly, an object of the present invention is to provide an improved image forming apparatus which can overcome the above-described problems of the prior art.

Another object of the present invention is to provide an image forming apparatus which can form an image of a uniform image quality,through elimination of unevenness occurring in the sub-scan direction.

Still another object of the present invention is to provide an image forming apparatus which performs a quality correcting operation in accordance with data indicative of variation or fluctuation in the feeding speed of a recording member.

According to one aspect of the present invention, there is provided an image forming apparatus which records an image on a recording medium by a recording means which performs recording in the main scan direction in accordance with image signals, comprising: relative movement means for causing, after one line of main scan recording by the recording means, relative movement between the recording means and the recording medium in a sub-scan direction which is different from the main scan direction; and control means for effecting a correction of recording density unevenness caused by a variation of the speed of the relative movement, by controlling recording conditions of the recording means in accordance with the variation in the speed of relative movement.

According to another aspect of the present invention, an image forming apparatus includes a photosensitive member, exposure means, developing means, and control means. The exposure means scans the photosensitive member in a main scan direction substantially perpendicular to a direction of rotation of the photosensitive member to form an electrostatic latent dot image. The developing means develops the electrostatic latent image on the photosensitive member. The control means controls the exposure means in accordance with a variation in the speed of rotation of the photosensitive member so as to eliminate any unevenness of image density of the electrostatic latent dot image which may be caused by the variation in the rotation speed.

According to yet another aspect of the present invention, there is provided ah image forming apparatus including recording means, relative movement means, and control means. The recording means is scanningly movable in a raster direction for recording an image on a recording medium in each raster scan. The relative movement means causes relative movement between the recording means and the recording medium in a sub-scan direction substantially perpendicular to the raster direction at a relative speed. The control means controls recording conditions of the recording means in accordance with any change in the relative speed of movement between the recording means and the recording medium in the sub-scan direction.

These and other objects, advantages and features of the present invention will become clear from the following description of the preferred embodiments when the same is read in conjunction with the accompanying drawings.

DESCRIPTION OF THE PREFERRED EMBODIMENTS

First Embodiment

Figure 1:
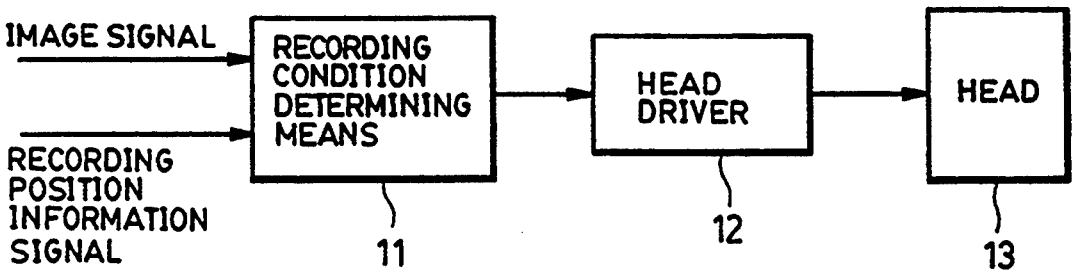
FIG. 1 is a block diagram showing the basic concept of the present invention.

FIG. 1 is a block diagram showing basic construction of the image forming apparatus of the present invention. As will be seen from this Figure, the image forming apparatus of the present invention has a recording condition determining means 11 which receives, in addition to image signals, a recording position, information signal indicative of the recording position of a head 13, and which controls the head 13 through a head driver 12. When the invention is applied to a digital image forming apparatus, it is possible to use a pixel signal identifying a pixel for printing, as the recording position information signal. This, however, is only illustrative and various other signals such as a clock signal may be used as the recording position information signal.

The present invention can be carried out in a variety of manners according to the degree of the image unevenness to be corrected, cost and other factors. For instance, the invention can suitably but not exclusively be applied to an ink-jet full multi-color copying apparatus which can be produced at a low cost and which can perform color copying at high speed and with high degree of reliability, as will be understood from the following description.

The ink-jet full multi-color copying apparatus will be explained as having a multiple-type recording head, typically a full multi-nozzle head having a plurality of ink discharging nozzles arranged over a linear region corresponding to the length of an A-4 size paper. The embodiment which will be described hereinunder has an ink jet recording head which discharges an ink droplet from each discharge hole of each nozzle as a result of a change in the state of the ink caused by a controlled application of heat energy.

Figure 2:
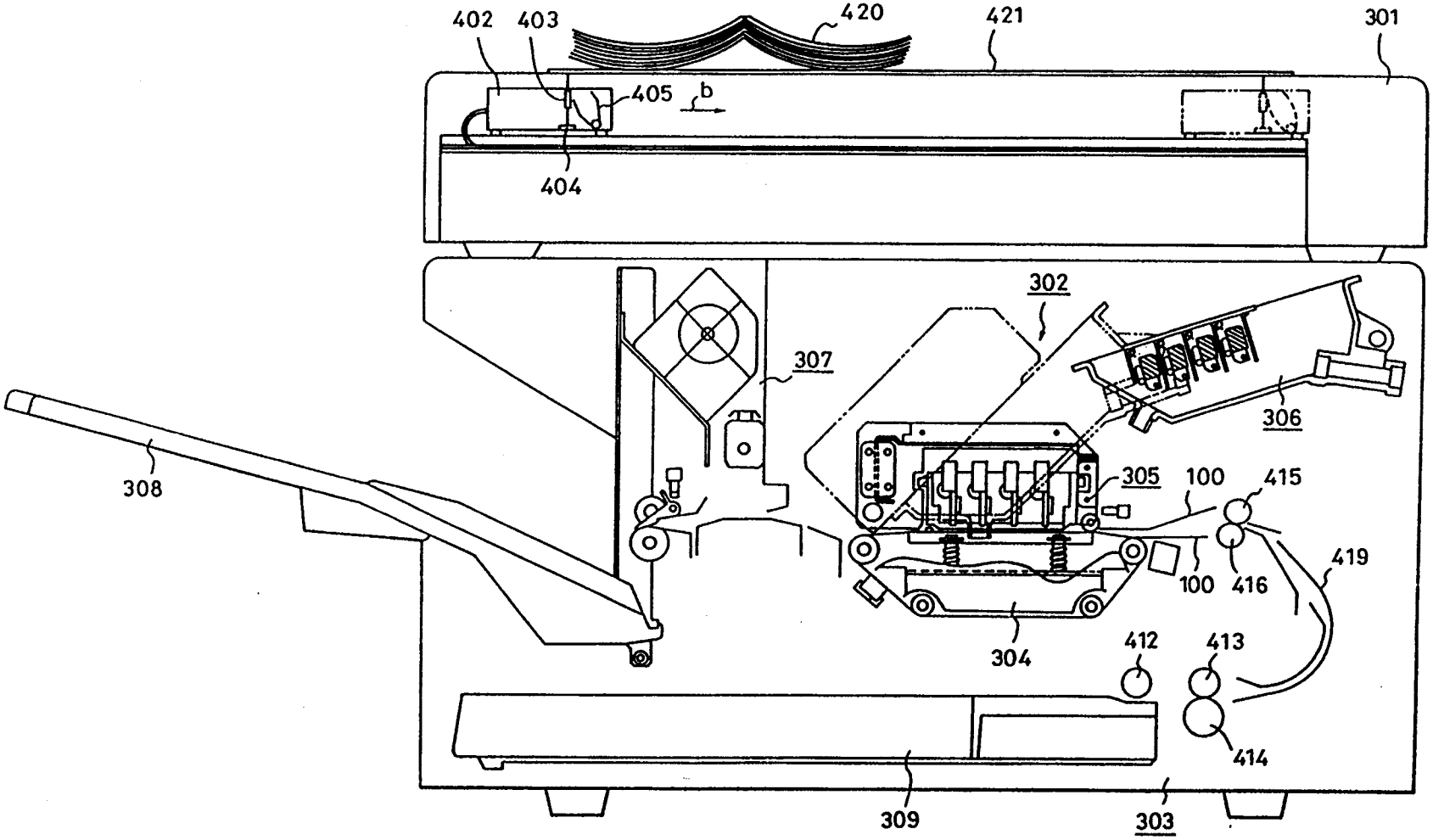
FIG. 2 is a sectional view of a digital color copying apparatus to which the present invention is applied.

FIG. 2 schematically shows in section an ink-jet type digital color copying apparatus embodying the present invention.

Referring to this Figure, the copying apparatus has a scanner section 301 which reads an original image and coverts the image into electrical signals. The output signals from the scanner section 301 are delivered as driving signals to a recording head section 305 of a printer section 302. Numeral 402 designates a reading unit incorporated in the scanner section 301. The reading unit has an optical system 403, a photosensor 404, and an illuminating system 405. The reading unit 402 moves in the direction indicated by the arrow b so that the photosensor 404 scans and reads the image of an original 420 placed on an original table 421. A paper feed section 303 has a paper cassette 309 containing a stack of sheets of recording paper and feeds the sheets in a one-by-one fashion from the cassette 309 to a belt type conveyor section 304 by means of a pickup roller 412. Numerals 413 and 414 denote supply rollers which receive the recording paper sheet from the pickup roller 412 and supply the same to a path 419. Numerals 415, 416 denote register rollers which are disposed on the outlet side of the path 419 and which receive the recording paper which has been conveyed through the path 419 and supply the same into a space between a pair of guide plates 100 which are provided on the inlet side of a belt-type conveyor section 304.

An image is recorded on the recording paper by the aforementioned recording head section 305 as the recording paper passes through the belt-type conveyor section 304. The recording paper is finally ejected to a tray 308 via a fixing/ejecting section 307 in which the image is fixed.

Numeral 306 denotes a recovery cap which functions to maintain the recording head section 305 in a state ready for operation. More specifically, during suspension of the recording operation,the recovery cap 306 is moved to the position shown by two-dot-and-dash line so as to cap the recording head section 305, thereby preventing ink from solidifying in the ink discharge ports of the nozzles. In addition, when the recording operation is not started within a predetermined time period after the power supply is turned on, a suction pump is automatically started to forcibly suck ink from the capped discharge openings of the nozzles of the recording head unit, thereby recovering the head unit and maintaining good discharging conditions.

Figure 3:
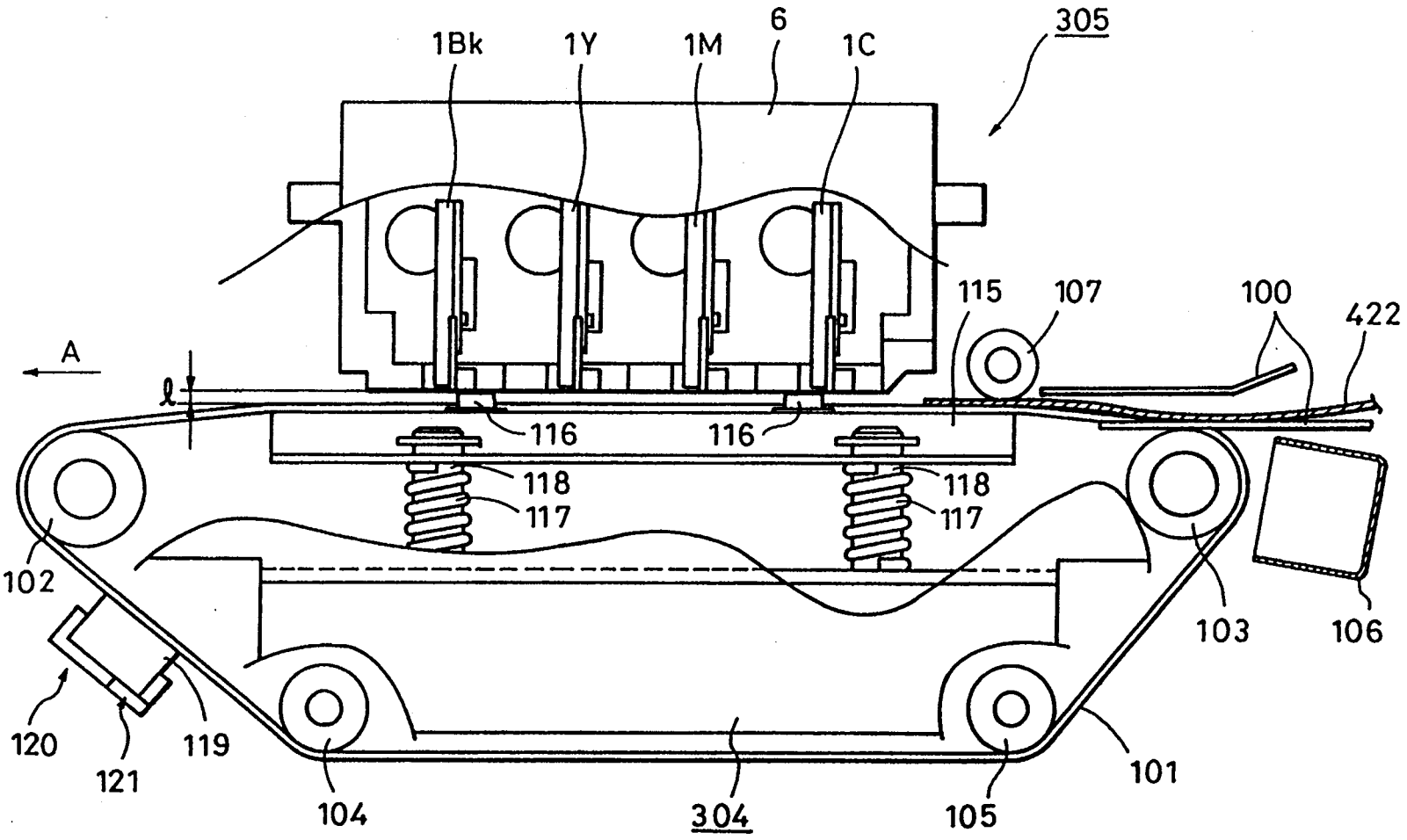
FIG. 3 is a sectional view of a recording medium conveying portion and a printing portion of the apparatus shown in FIG. 2.
Figure 4:
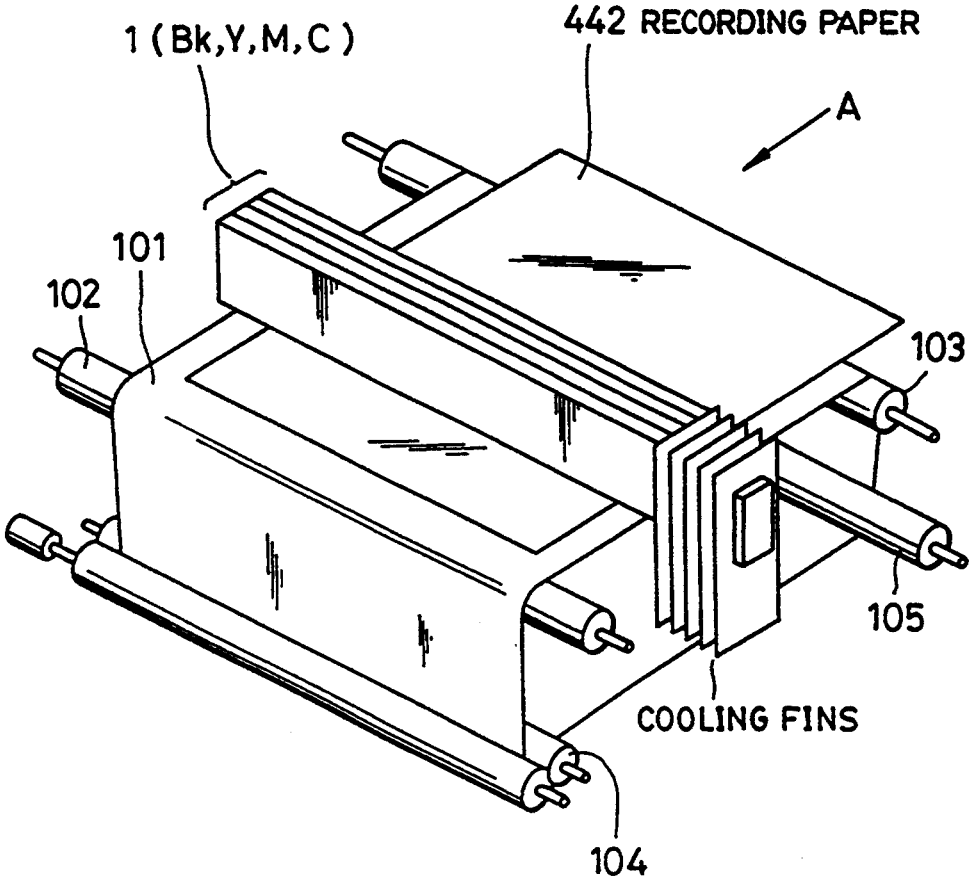
FIG. 4 is a perspective view of the portions shown in FIG. 2.

The belt-type conveyor section 304, Which serves as means for conveying the recording paper sheet, will be described in detail with specific reference to FIGS. 3 and which are schematic illustrations of the conveyor section 304.

The recording paper sheet 422 which has been delivered by the register rollers 415, 416 is moved along the guide plates 100 and reaches a conveyor belt 101. The conveyor belt 101 has a two-layered structure composed of a paper-contacting, insulating layer having a volumetric resistivity of $10^{12}\Omega$.cm or greater and an electrically conductive carrier layer having a volumetric resistivity of 10 Ω.cm or less. The conveyor belt 101 is an endless belt wound around a drive roller 102, an idle roller 103, and tension rollers 104, 105 which tense the belt with a tensile force of 2 to 5 kg. The drive roller 102, which is driven by a motor (not shown), rotates to drive the belt 101 in the direction of the arrow A.

The recording paper 422 is placed on the conveyor belt 101 at a position immediately upstream of a grounded conductive roller 107 as viewed in the direction of conveyance of the belt 101. The surface of the belt 101 has been electrostatically charged to a potential of several to several hundreds of volts by means of a charger 106. When the paper moved onto the conveyor belt 101 reaches the grounded conductive roller 107, an electrostatic attracting force is generated between the recording paper 422 and the conveyor belt 101 so that the recording paper 422 is moved in close contact with the conveyor belt 101. The recording paper is thus conveyed to the position where the recording head section 305 is located. The recording head section 305 includes a head block 6, recording heads 1C, 1M, 1Y and 1Bk provided on the block 6, a platen 115 on the backside of the belt 101, pins 116, springs 117 and guide pins 118. In the recording head section 305, it is necessary that the distance between the recording heads 1C, 1M, 1Y and 1Bk and the surface of the recording paper is maintained precisely on the order of about 100 μm. To this end, the surface of the platen 115 which contacts the conveyor belt 101 has a high degree of flatness, e.g., several μm, thereby ensuring that the surface of the conveyor belt 101 is held in a high degree of flatness in the recording head section 305. In addition, the recording heads. 1C, 1M, 1Y and 1Bk are located on the head block 6 such that the surface formed by the orifice surfaces of all heads exhibit a high degree of flatness, e.g., several μm in roughness. The locating pins 116 are provided on the platen 115. The platen 115 is movable vertically. The platen 115 is urged upward by the force of the springs 117 so as to move along the guide pins 118. The upward movement of the platen 115, however, is stopped when the upper ends of the locating pins 116 abut the head block 6, so that a clearance l is formed to provide a passage for the recording paper. According to this arrangement, it is possible to maintain the distance between recording surface of the recording paper 422 and the orifice surfaces of the head within a tolerance of about 100 μm with respect to the set distance, because the recording paper 422 is held in close contact with the conveyor belt 101 by the electrostatic attracting force.

Images of different colors are recorded successively by the recording heads 1C, 1M, 1Y and 1Bk as the recording paper 422 passes through the recording head section 305. If the speed of conveyance of the recording paper by the conveyor belt fluctuates largely, positions of recording by the successive heads are deviated to cause color misregistration or color unevenness in the color image. Factors such as the precision of the thickness of the conveyor belt 101, oscillation of the drive roller 102, precision of angular velocity of the drive motor and so forth are determined precisely in order to eliminate these defects.

The recording paper 422, carrying the recorded image and still held in close contact with the conveyor belt 101, is moved to the position above the drive roller 102 where the belt 101 runs arcuately around the drive roller 102 to separate from the recording paper 422. The recording paper 422 thus separated from the conveyor belt 101 is delivered to the fixing section.

Subsequently, the surface of the conveyor belt 101 is cleaned by a cleaner 120 which has an ink absorptive member 119. The ink absorptive member 119 is made of a continuous porous material such as polyvinyl formal. The ink absorbed by the ink absorptive member 119 is discharged to the exterior through the ink opening 121.

Figure 5:
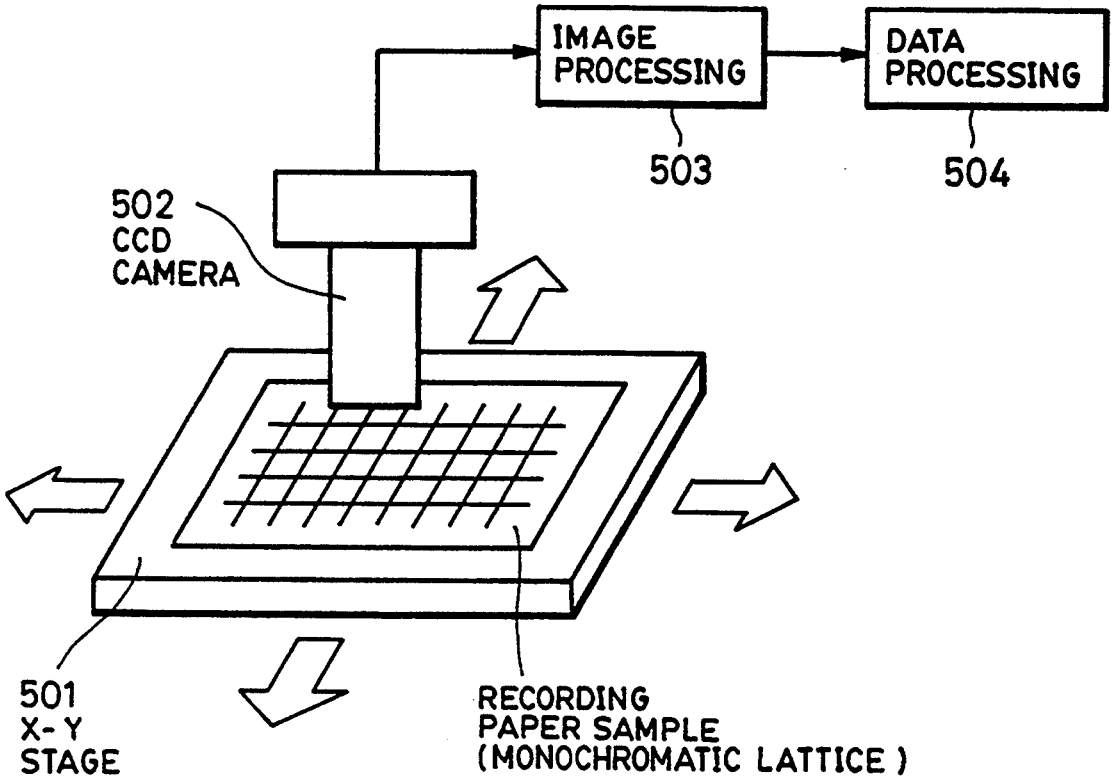
FIG. 5 is a block diagram of an automatic lattice pitch reading device.
Figure 6:
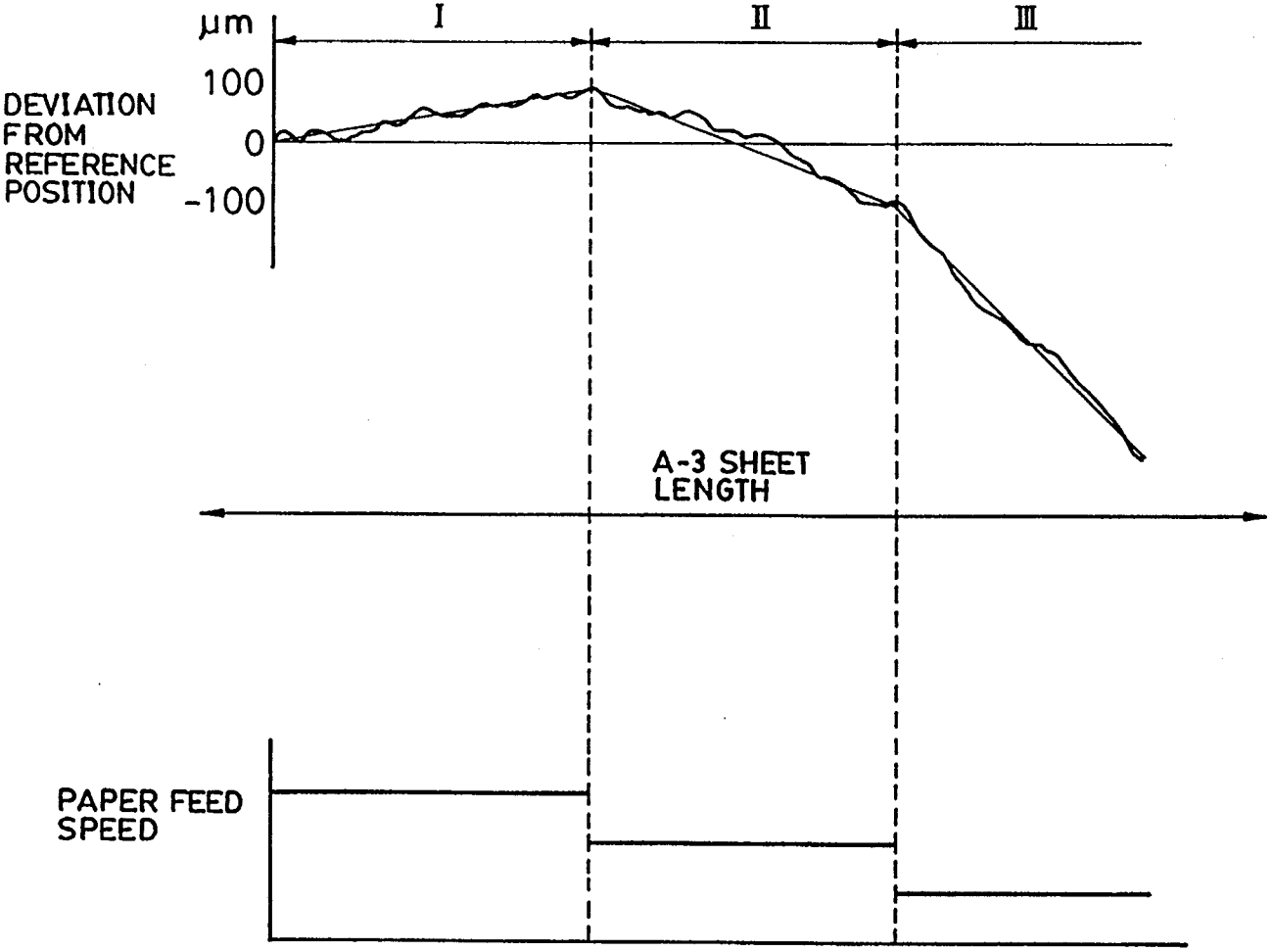
FIG. 6 is a diagram showing the relationship between the amount of deviation of a lattice pattern printed on an A-3 size paper from a reference position and the speed of feed of a recording paper sheet.
Figure 7A:
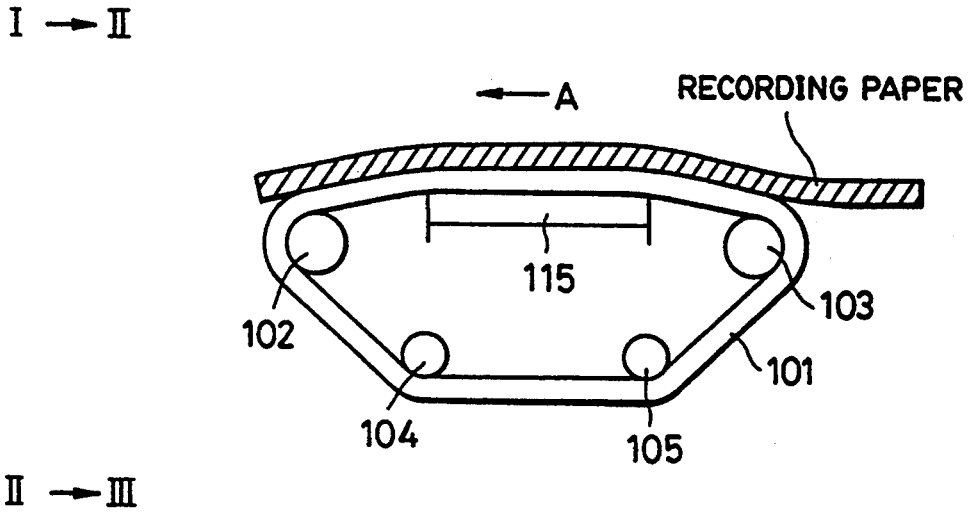
FIGS. 7(*a*) and 7(*b*) and FIGS. 8(*a*) to 8(*g*) are illustrations of slacking and tightening of a belt occurring during feed of a recording medium.
Figure 7B:
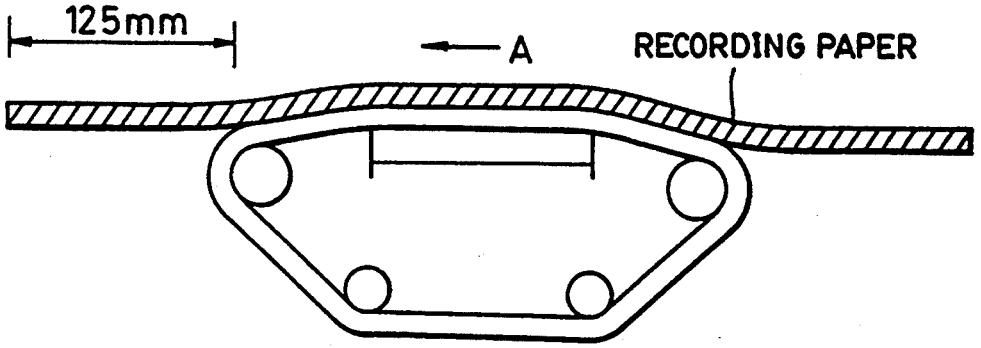
Figure 8A:
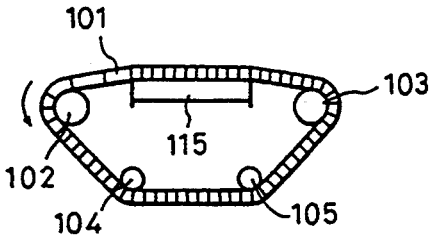
Figure 8B:
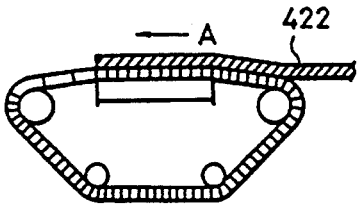
Figure 8C:
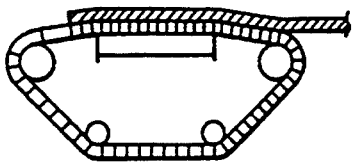
Figure 8D:
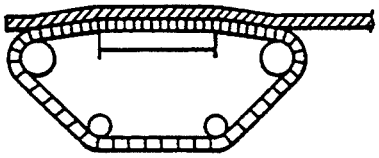
Figure 8E:
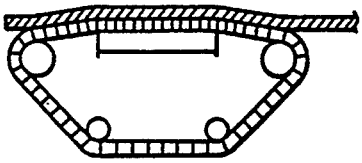
Figure 8F:
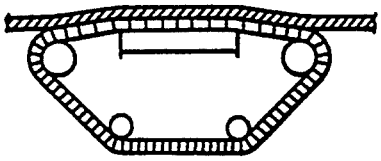
Figure 8G:
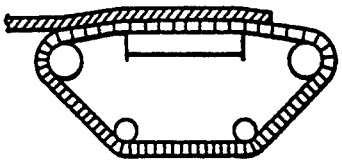

A test operation was conducted in which a monochromatic lattice pattern composed of crossing lines extending in the direction of main and sub-scans was formed on a recording paper of A-3 size, and the lattice pitch of this lattice pattern was read by an automatic reading device as shown in FIG. 5. More specifically, a sample of recording paper carrying the lattice pattern was placed on an X-Y stage 501 movable in X and Y directions, and the image of the monochromatic lattice pattern on the recording paper was picked up by a stationary CCD camera 502 the output of which was delivered to an image processing device 503. Digital data thus obtained was then processed by a data processor 504 such as a computer, and amounts of deviation of the squares of the lattice pattern from reference positions were determined. The amounts of deviation thus measured are shown in FIG. 6. The curve representing deviations of the lattice pattern is divided into three regions I, II and III over the length of the A-3 size recording paper. The curve is substantially linear in each of these regions but gradients are different in different regions. The gradient is substantially proportional to the speed of conveyance of the recording paper during the recording. The paper speed varies in three stages as schematically shown in FIG. 6, corresponding to the gradients in the deviation curve. The positions of the recording paper at which the paper speed changes from the speed corresponding to the region I to the speed corresponding to the region II and from the speed corresponding to the region II to the speed corresponding to the region III are always constant relative to the conveyor belt, as will be seen from FIG. 7.

The manner in which the speed of the recording paper varies will be described with reference to FIGS. 8(*a*) to 8(*g*).

When the conveyor belt 101 is being driven, the belt 101 is stretched or slightly elongated in the region between the shoulder portion of the platen and the drive roller 102 due to resistance caused by friction between the belt 101 and the platen 115, as shown in FIG. 8(*a*).

However, when a recording paper 422 as the recording medium is supplied and electrostatically attracted on the conveyor belt 101 as shown in FIG. 8(*b*), the stretching or elongation of the conveyor belt is restrained by the recording paper, so that the conveyor belt 101 moves without substantial elongation, as will be seen from FIG. 8(*c*). The portion of the conveyor belt 101, which has been elongated as shown in FIG. 8(*a*) is moved past the drive roller, so that the lower run of the conveyor belt 101 is slightly elongated or slackened. The portion of the conveyor belt 101, the stretching of which has been restrained by the recording paper, is gradually relieved from the restraining force when it reaches in the vicinity of the drive roller 102, because the recording paper starts to progressively leave the conveyor belt 101 due to a reduction in the electrostatic attracting force and due to the stiffness of the recording paper. Consequently, this portion of the conveyor belt 101 starts to be gradually stretched and elongated, Consequently, the speed of convey of the recording paper starts to decrease even though the drive roller 102 rotates at a constant speed, as shown in FIGS. 8(*d*) and 8(*e*). This is the reason why the change in the speed of conveyance of the recording paper from region I to region II takes place. A further movement of the conveyor belt 101 advances the recording paper so that the trailing end portion of the recording paper is held on the conveyor belt 101. In this state, the force which restrains the elongation of the belt 101 is reduced so that the belt 101 is stretched again, with the result that the speed of conveyance is further reduced, as shown in FIGS. 8(*f*) and 8(*g*). This is the reason why change in the speed of conveyance of the paper takes place from region II to region III.

In order to eliminate the variation in the speed of convey of recording paper occurring in the conveyor system of the type described, various measures have been taken such as the provision of a roller which presses the conveyor belt 101 onto the drive roller 102, enhancement of the hardness of the conveyor belt 101, adjustment of the coefficient of friction between the inner surface of the conveyor belt 101 and the drive roller, and so forth. These measures, however, are still unsatisfactory and there has been no means which would reduce the speed variation to an acceptable level. Recording of an image such as color characters under such a speed variation makes the recorded image vague and obscure.

Figure 9:
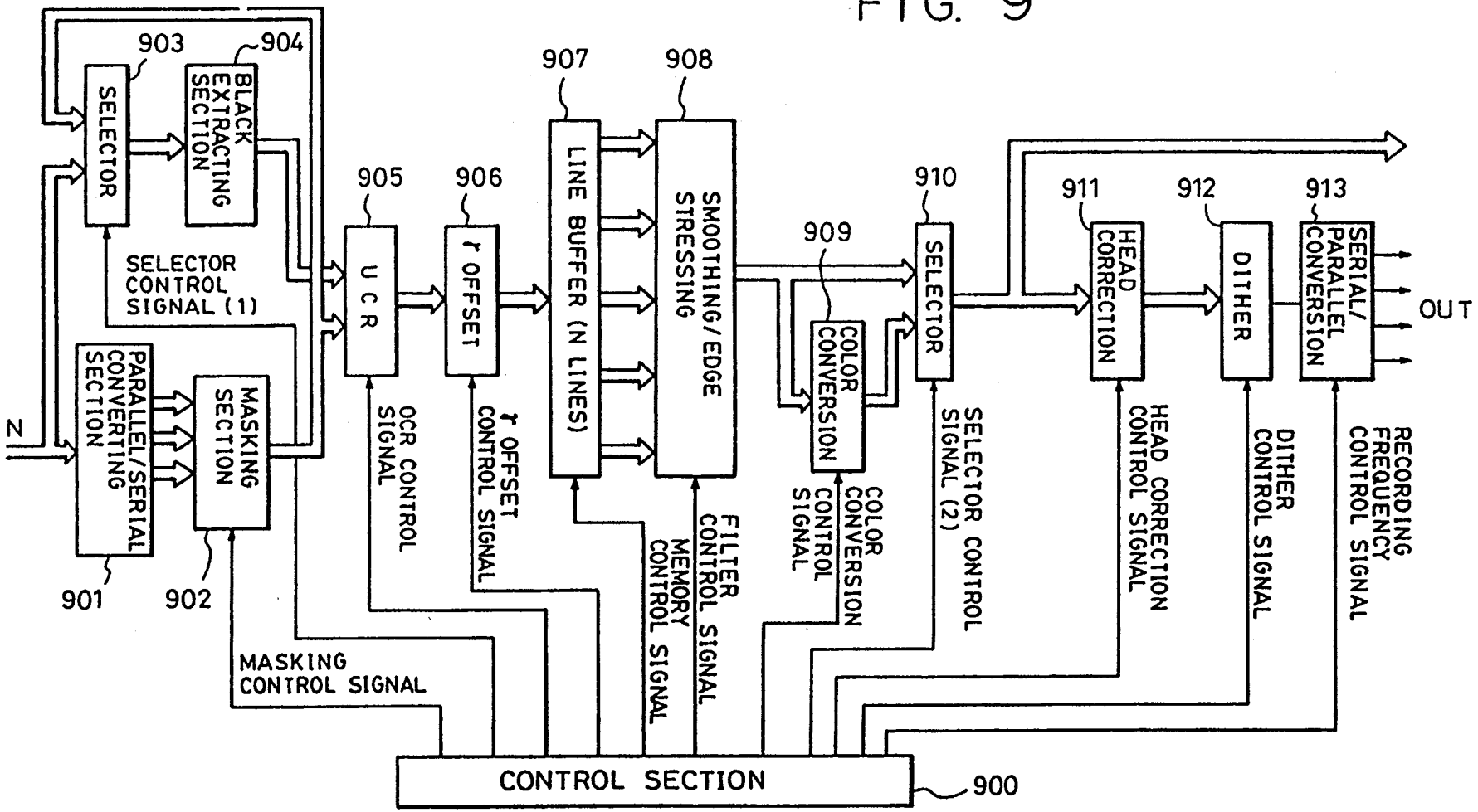
FIG. 9 is a block diagram of an electrical correcting circuit used in the present invention.

According to the present invention, the correction of unevenness in the recording quality, caused by the variation in the speed of conveyance of the recording paper, is performed electrically by an image processing section which is shown in FIG. 9.

Referring to FIG. 9, an image of an original (not shown) is read by the scanner section 301 mentioned before and is changed into serial electrical signals of a predetermined order, e.g., R, G, B by processing means (not shown) which includes A/D conversion means. The image data formed by the serial signals is input to a selector 903 of the processing section shown in FIG. 9. The image data also is delivered to a serial/parallel converting section 901 so as to be changed into parallel signals Y(yellow), M (magenta) and C (cyan) which are delivered to a masking section 902.

The masking section 902 is a circuit for effecting correction against turbidity of the color of an output ink. More specifically, the masking section 902 performs the following computation:

$$\begin{pmatrix} Y' \\ M' \\ C' \end{pmatrix} = \begin{pmatrix} a_{11} & a_{12} & a_{13} \\ a_{21} & a_{22} & a_{23} \\ a_{31} & a_{32} & a_{33} \end{pmatrix} \begin{pmatrix} Y \\ M \\ C \end{pmatrix}$$

*Y, M, C*: input data
*Y', M', C'*: output data

These nine coefficients are determined by a masking control signal from a control section 900. After the correction of any turbidity performed by the masking section 902, the parallel signals are changed into serial signals which are then delivered to the selector 903 and a UCR section 905.

Thus, the selector 903 receives both input image data and image data delivered by the masking section 902.

The selector 903 normally selects input image data in accordance with the selector control signal 1 which is given by the control section 900. If color correction has not been conducted sufficiently in the input system, the selector 903 operates in response to the selector control signal 1 so as to select the image data output from the masking section 902. In this case, therefore, the image data received from the masking section 902 is output from the selector 903. The serial image data output from the selector 903 is input to a black extracting section 904. Minimum levels of colors Y, M, C in each pixel are determined as black data, so that the black extracting section 904 extracts the minimum values in the color image data Y, M, C. The black data thus detected is input to the UCR section 905.

In the UCR section 905, extracted black data is subtracted from each of the input data Y, M and C. The black data itself is simply multiplied with a coefficient. More specifically, the UCR section 905 conducts a correction for time mis-registration between the black data and the image date received from the masking section 902. The UCR section 902 then conducts the following computation:

$$Y' = Y - a_1 Bk$$

$$M' = M - a_2 Bk$$

$$C' = C - a_3 Bk$$

$$Bk' - a_4 Bk$$

wherein Y, M, C and Bk shows input data, while Y', M', C' and Bk' represent output data.

The coefficients $a_1$, $a_2$, $a_3$ and $a_4$ are determined by UCR control signals delivered from the control section 900.

Subsequently, the data output from the UCR section 905 is input to a $\gamma$ offset section 906.

The $\gamma$ offset section 906 performs a gradation correction by executing the following computation.

$$Y' = b_1(Y - C_1)$$

$$M' = b_2(M - C_2)$$

$$C' = b_3(C - C_3)$$

$$Bk' = b_4(Bk - C_4)$$

wherein Y, M, C and Bk are data input to the $\gamma$ offset section, while Y', M', C' and Bk' are data output from the $\gamma$ offset section.

The coefficients $b_1$ to $b_4$ and $c_1$ to $c_4$ are determined by a $\gamma$ offset control signal which is given by the control section 900.

The signal which has been gradation-corrected by the $\gamma$ offset section 906 is delivered to a line buffer 907 which stores image data corresponding to N lines. The line buffer 907 operates in accordance with a memory control signal from the control section 900 so as to deliver, in a parallel manner, required 5-line data to a smoothing/edge stressing section 908. The 5-line data, delivered to the Smoothing/edge stressing section 908, are input to a variable-size space filter so as to be smoothed in accordance with a filter control signal delivered from the control section 900. Edge stressing is then conducted.

The image data which is output from the smoothing/edge stressing section 908 is input to a color conversion section 909 which performs color conversion in accordance with a color conversion control signal given by the control section 900.

Commands such as the color which is to be converted, the color to which a color is to be converted, valid area in which the color conversion is to be performed, and so forth, are beforehand input from a digitizer (not shown) via the control section 900. The color conversion section 909 performs the color conversion in accordance with these commands. The detail of the color conversion section 909 is not described because it does not form any critical part of the invention. The image signals output from the smoothing/edge stressing section 908, as well as image signals after the color conversion, are delivered to a selector 910 which operates in accordance with a selector control signal 2 so as to select the image data to be output. Which data is to be selected is determined in accordance with the valid area command input from the digitizer. The image signals selected by the selector 910 are input to a buffer memory, a binary-coding processing section (not shown) and a head correction section 911 which performs correction of unevenness of image in the direction of main scan, i.e., in the direction of array of nozzles.

Figure 10:
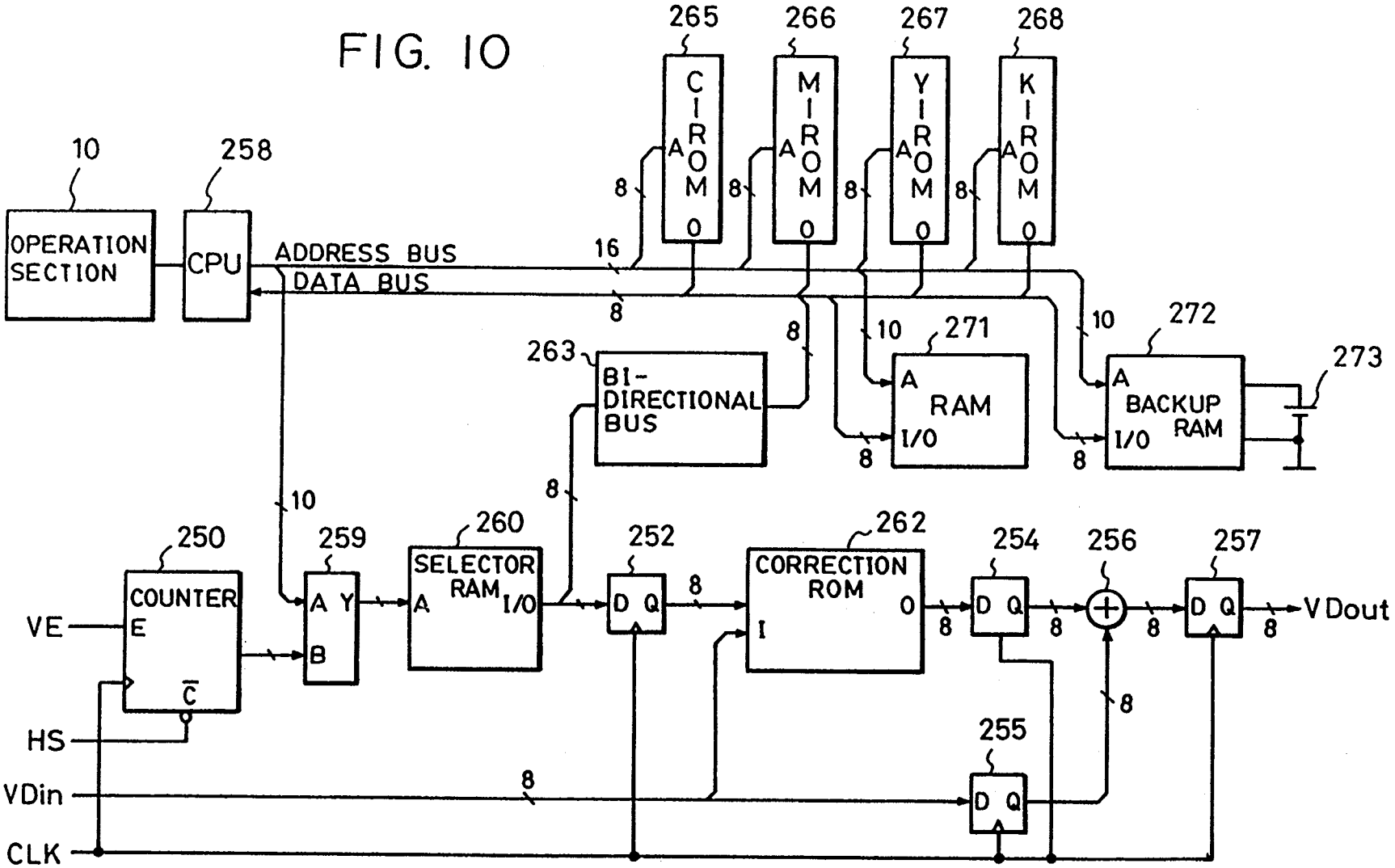
FIG. 10 is a block diagram of a circuit for effecting unevenness correction in the direction of main scan in which nozzles are arrayed.

A detailed description will be given of the head correction section 911 with specific reference to FIG. 10 which is a block diagram of the head correction section of FIG. 9.

The head correction section 911 includes an address counter for generating an address in a correction amount selection table RAM 260 (referred to as "selection RAM"). The address counter operates in response to a signal KS and a signal VE, so as to count values corresponding to the numbers of the nozzles of all heads of four colors. The signal VE is a signal which indicates the valid length of the image per line as read by the photosensor 404.

The signal CLK is a clock signal for delivering the image data VD. The signal VE varies in synchronization with the signal CLK.

The signal HS is a signal which is used when valid and invalid sections alternately appear during outputting of the signal VE over one line. The signal HS, therefore, is not used when the image is valid throughout the period of output of the signal VE over one line. Thus, the signal HS indicates the start of image output in each line.

Numerals 265 to 268 denote characteristic ROMs which store printing density unevenness characteristics of the nozzles on the respective heads. The ROMs 265 to 268 also store printing density unevenness correction data for the respective nozzles of the heads.

$VD_{in}$ successively receives, in a pixel-sequential manner, color component image data VD for each pixel in a manner like C,M,Y,K,C,M,Y,K. The selection RAM 260 picks up data from ROMs 265 to 268 in accordance with the sequence of the input image data and stores the picked up data. The data picked up from the ROMs 265 to 268 are written in the RAM 260 by means of a bidirectional buffer 263.

A selector 259 selects one from a 10-bit output from the counter 250 and less-significant 10-bit data of the address in a 16-bit address BUS which is output from a CPU 258. To realize a mode for wiring data into the RAM 260, the selector 259 selects the output from the CPU 258, whereas, when reading of data from the RAM 260 is to be executed, the selector 259 selects the output from the counter 250.

The data output from the RAM 260 is input to the address of a correction table ROM 262 (referred to as "correction ROM") through a flip-flop 252, together with the image data VD.

Figure 11:
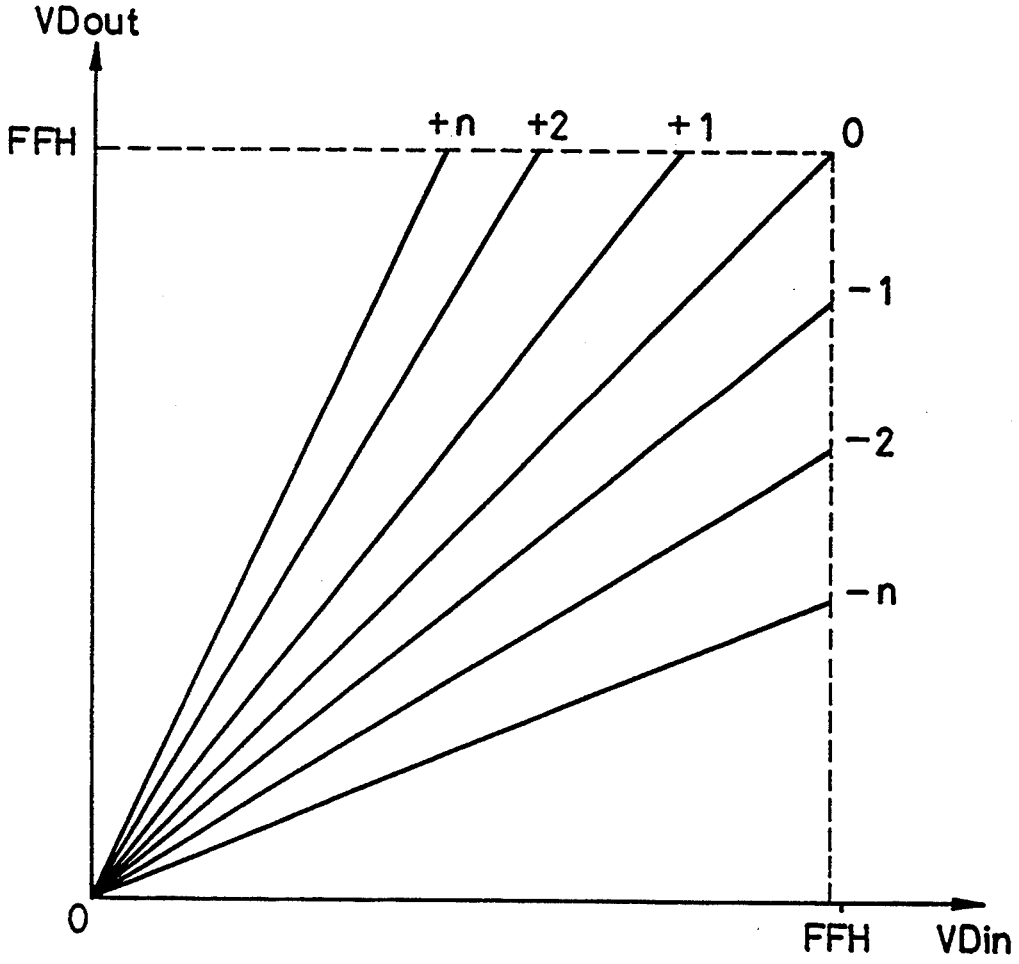
FIG. 11 is an illustration of a conversion table employed in the circuit shown in FIG. 11.

The correction ROM 262 stores correction tables $-n$ to $+n$ as shown in FIG. 11. Thus, the correction ROM 262 stores $(2n+1)$ correction tables. Practically, however, 61 correction tables, covering a range between $-30\%$ and $+30\%$ at a gradation of 1%, is enough for realizing the intended correction. Each table in the correction ROM 262 is written in such a manner as to output a correction data $\Delta A$ in response to an input A. In operation, a correction data $\Delta A$ is selected in accordance with the image signal VD and the selection data which are given to the ROM 262. The correction data $\Delta A$ is temporarily latched by the flip-flop 254 and is added to the input image data A by an adder 256, whereby a corrected data $A+\Delta A$ is obtained. This corrected data is output to a dither circuit 912 through a flip-flop 257.

The dither circuit 912 performs a dither processing of the input signal in accordance with the dither control signal from the control section 900, so as to binarize the input signal. The binarized output signal is output through a serial-to-parallel conversion circuit 913 which operates to convert the input signals (serial) to parallel signals. The parallel signals are then delivered to a head driver (not shown) so as to drive recording heads. It is possible to eliminate density unevenness of the image appearing in the direction of the main scan, by operating the recording heads in accordance with the corrected data which are obtained through the described process.

A working RAM 271 is used for enabling writing of characteristic data derived from the characteristic ROMs 265 to 268 into the selection RAM 260. A backup RAM 272 serves to hold the data written in the selection RAM 260 and is always kept ready for backup by the power from a battery.

As explained before in connection with FIG. 9, correction for mis-registration in the direction of the sub-scan, i.e., in the direction of conveyance of the paper, is effected by a control signal which is delivered from the control section 900 to the head driver and which adapts the ink discharge frequency to the characteristics of the apparatus.

Figure 12:
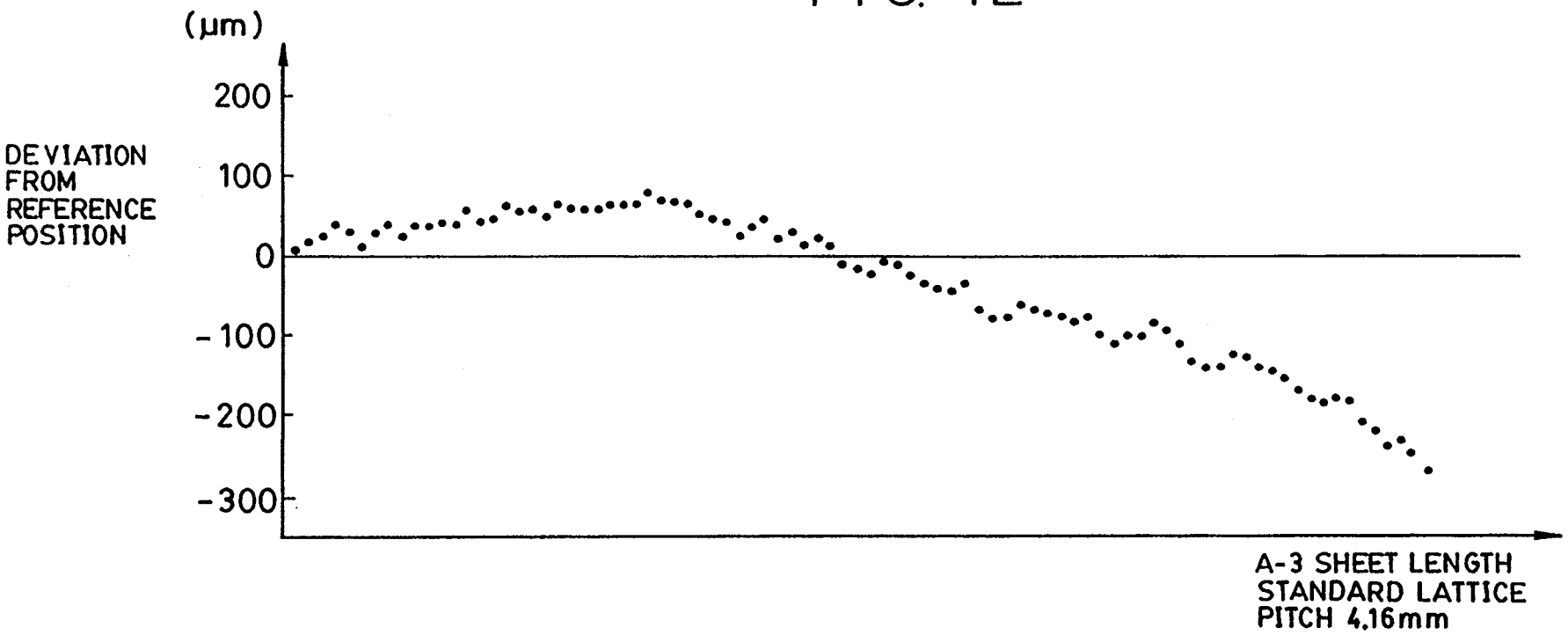
FIG. 12 is a graph showing the lattice pitch of an A-3 long lattice as measured by the device shown in FIG. 12.
Figure 13:
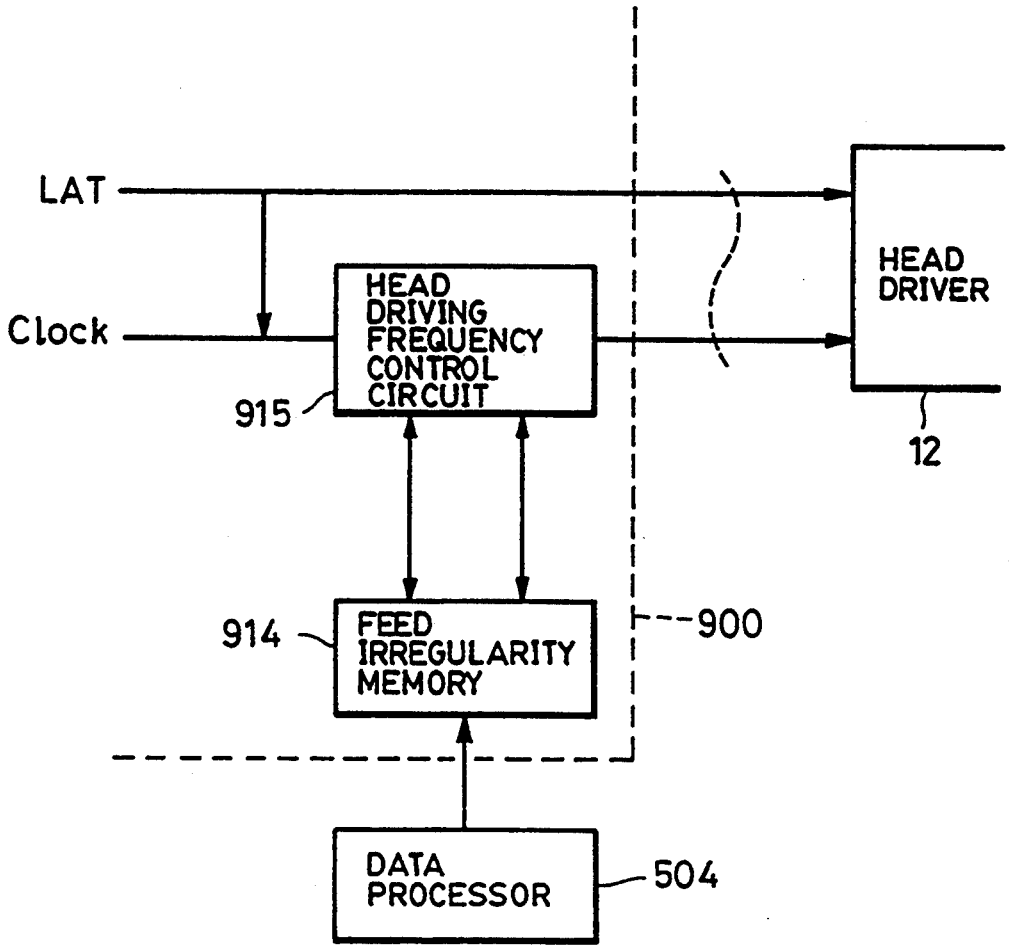
FIG. 13 is a block diagram of a frequency modulation circuit used in the present invention.
Figure 14:
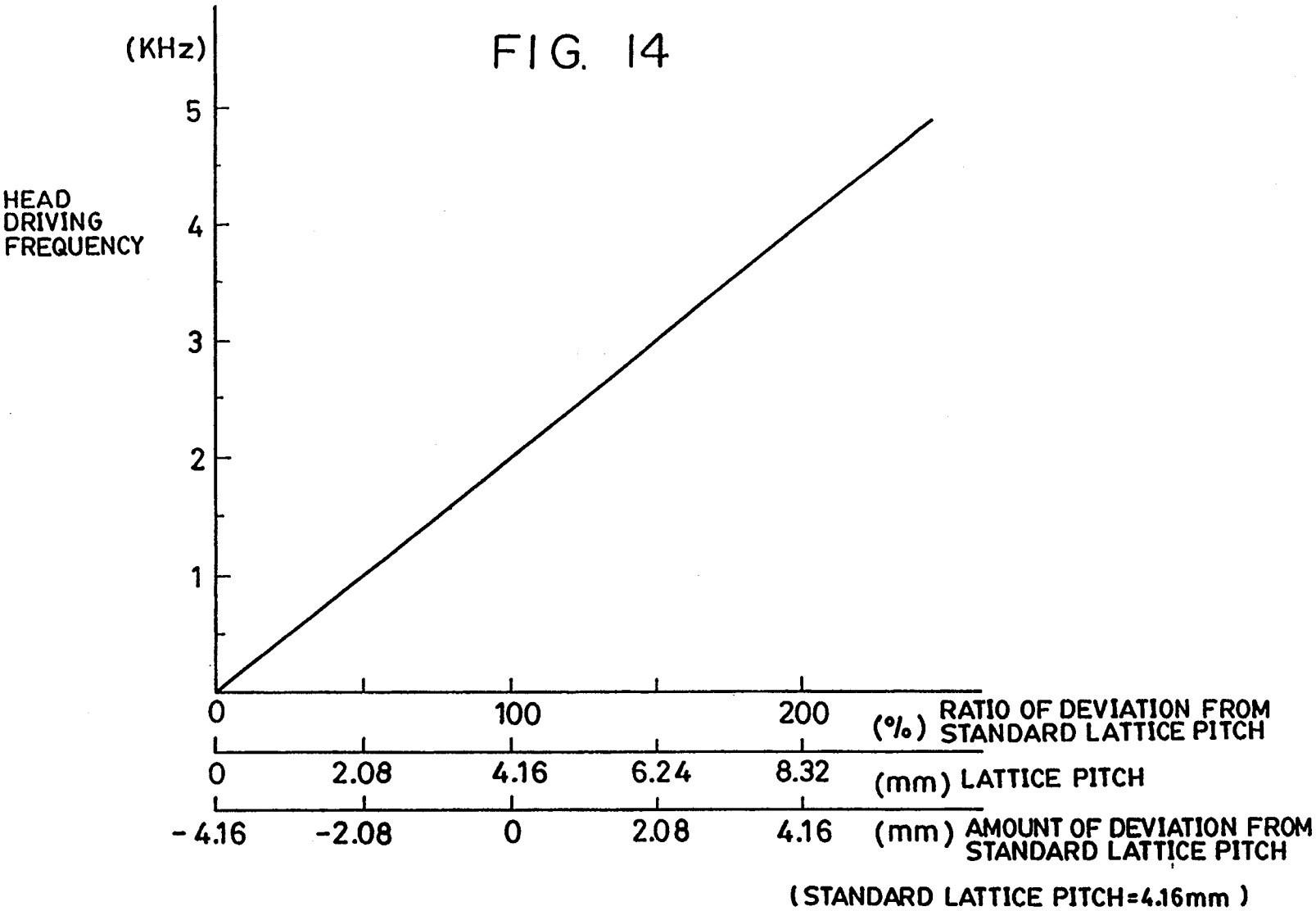
FIG. 14 is an illustration of the relationship between deviation occurring in the direction of sub-scan which is the direction of paper feed.

More specifically, the correction for mis-registration in the sub-scan direction is effected in the following manner. A lattice image of 4 mm lattice pitch is recorded on the whole area of an A-3 size paper by means of the color copying machine which is the same as that described before. Then, the lattice pitch is measured by an automatic reading device shown in FIG. 5. FIG. 12 shows an example of the results of the measurement. The reproducibility of the system has been confirmed. In FIG. 12, the axis of ordinate indicates the amount of assumed deviation of the printing position from a reference lattice position (starting position), while the axis of abscissa shows the lattice points between the reference point and the end of the A-3 size paper. This Figure, therefore, corresponds to FIG. 6. As will be seen from FIG. 13, the measured data is input from the processing device 504 to a feed irregularity memory 914. Then, a head drive frequency control circuit 915 determines the head driving frequency on the basis of the amount of deviation of the lattice pitch, in accordance with a calibration curve as shown in FIG. 14, in such a manner as to obtain coincidence between the measured lattice pitch in the memory 914 with the reference lattice pitch. The head driver is controlled to drive the heads in accordance with the thus determined head driving frequency. For instance, the recording in the region between a point which is 282.88 mm and a point which is 287.04 mm from the starting point is performed at a head driving frequency of 1.991 FHz because the lattice pitch in this region is 4.156 mm. The described correction method has been confirmed to be effective in correcting any unevenness which gently and regularly appear in the direction of the sub-scan. With this method, therefore, it is possible to obtain an image with reduced mis-registration and smaller distortion of the image. In order to maximize he effect of the described method, it is desirable that the factors such as the length of the drive roller belt are adjusted beforehand so as not to vary during conveyance of the recording paper.

Second Embodiment

The first embodiment described hereinbefore is to control the recording frequency of the head in accordance with detected unevenness of the image density. The invention, however, can be carried out in various other forms. For instance, the invention may be carried out in such a manner as to obtain uniform halftone level by controlling the recording density. In a second embodiment of the invention, the method described in connection with FIG. 10, used for effecting correction against fluctuation of characteristics of nozzles in the multi-nozzle, is applied also to control the recording density in the direction of sub-scan. This correction method employs,as described before, conversion tables or curves which are set as shown in FIG. 11 for each of the nozzles of all nozzle heads. Ideally, the correction is to be effected on each pixel on each line of sub-scan. This, however, is impractical considering that a very large memory capacity is required for storing the conversion table for each of the nozzles the number of which is 670 pixels×4700 for covering the entire length of the A-3 size paper. In addition, fine stripe-like unevenness does not usually occur in the direction of sub-scan. A correction for every 16 pixels, therefore, is sufficient.

Third Embodiment

Figure 15A:
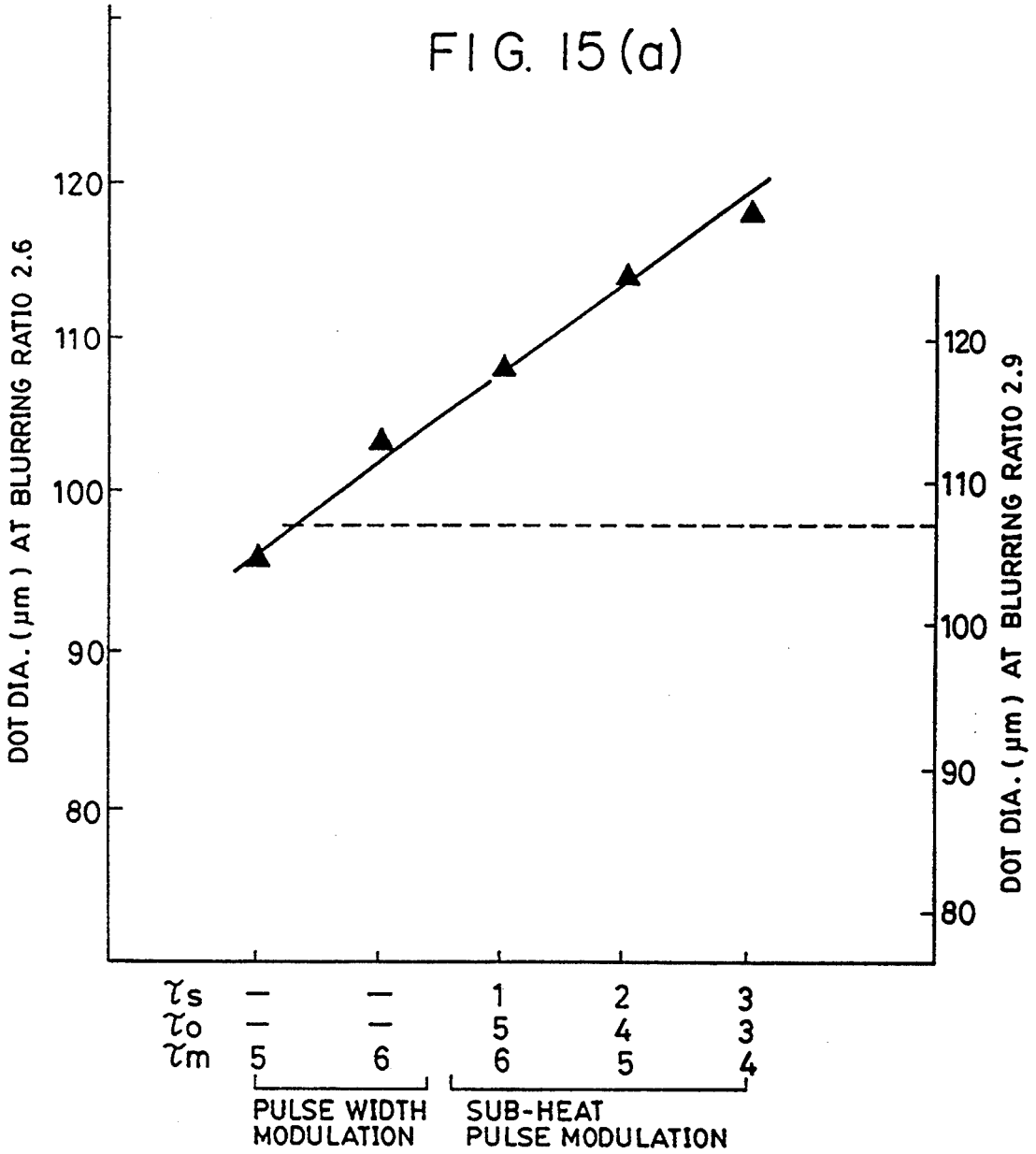
FIG. 15(*a*) is a diagram showing the relationship between printing dot diameter and FIG. 15(*b*) is a waveform of a pulse applied for controlling the dot diameter.
Figure 15B:
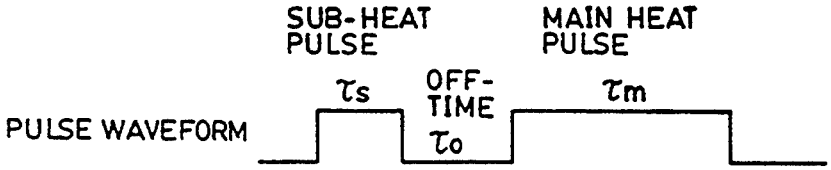
Figure 16:
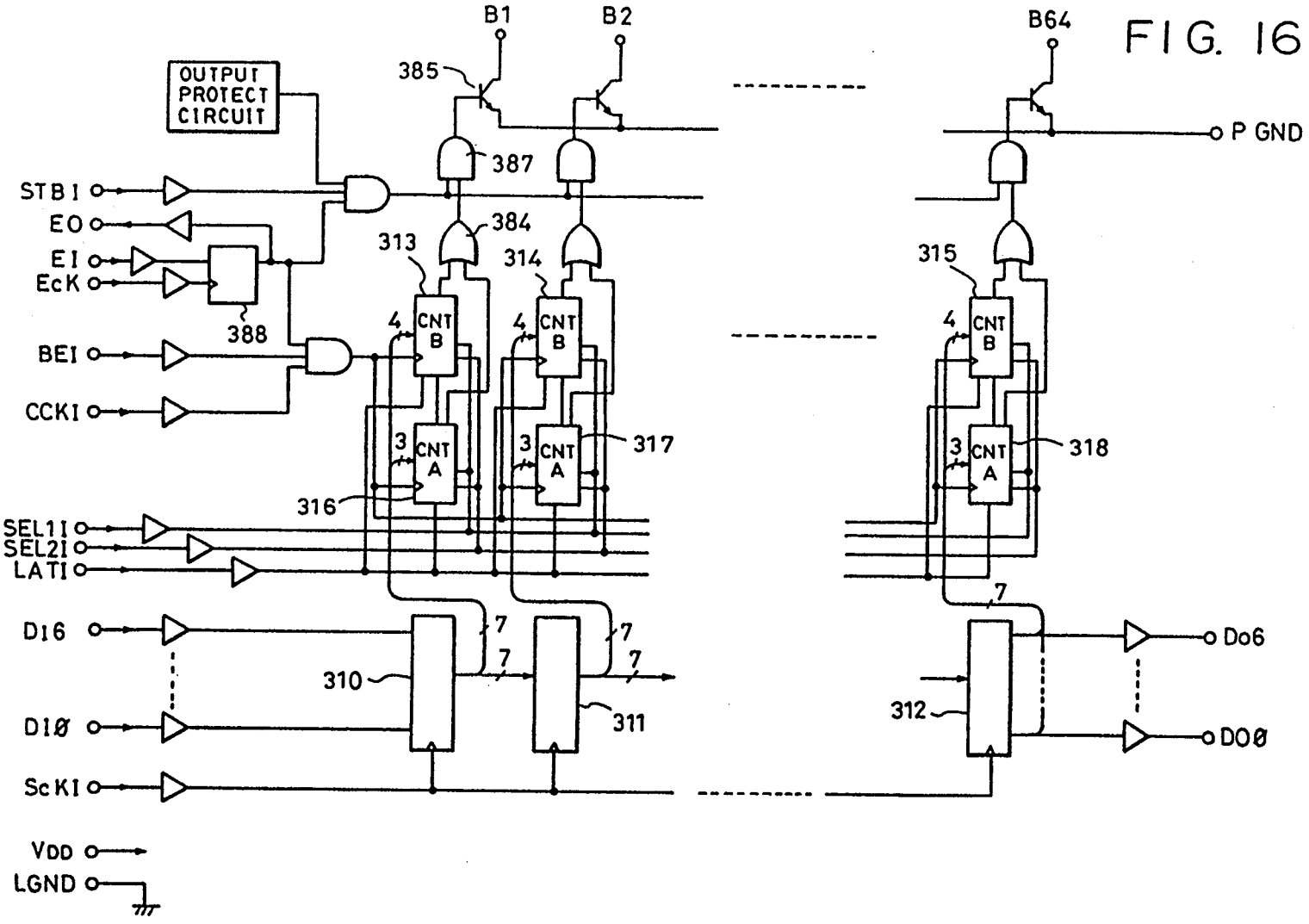
FIG. 16 is a block diagram of a sub-heat pulse drive circuit.

In the second embodiment, the recording density is controlled by varying the number of print dots per unit area, by changing the method of conversion of the image signals. This method is effective in the cases where multi-value signals are to be used as in copying apparatus. However, there also exists a demand for correction to be performed in apparatuses which handles binary signals, e.g., binary printers. Such a demand can be met most effectively by a dot-diameter control method which controls the diameters of the print dots. As in the preceding embodiments, the image unevenness characteristic is read by the automatic reader and head driving conditions are determined in accordance with the read unevenness characteristic. The head driving conditions for each sub-scan are stored in a memory. The recording is performed by driving the recording heads in accordance with the driving conditions read from the memory. In this embodiment, in order to facilitate the dot diameter control, the recording head are driven through pulse width modulation. Thus, the above-mentioned driving conditions are the waveforms of the driving pulses. An example of the pulse waveform is shown in FIG. 15(*b*). The relationship between the pulse width modulation and the dot diameter is shown in FIG. 15(*a*). As will be seen from FIG. 15(*a*), a simple pulse width modulation which varies the width of a single pulse is used in a small dot-diameter region, whereas, diameters of comparatively large print dots are controlled by a sub-heat pulse modulation method in which the width $\tau_s$ of a sub-heat pulse, the width $\tau_o$ of off time and the width $\tau_m$ of a main heat pulse are controlled independently. An example of a pulse waveform modulation circuit, which performs the dot-diameter control as described, is shown in FIG. 16.

Figure 17:
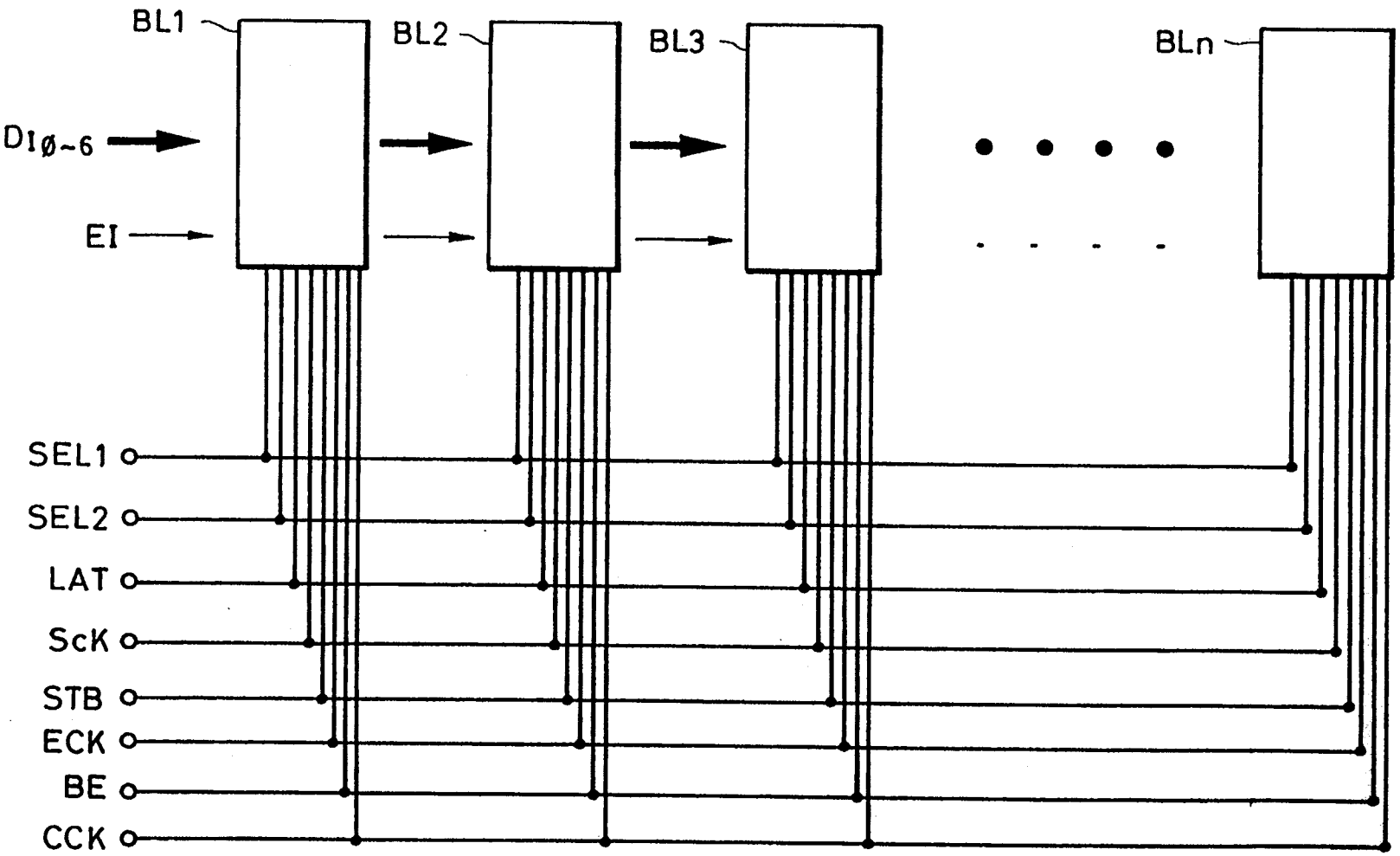
FIG. 17 is a block diagram of the whole driving circuit.

FIG. 17 is a block diagram of the whole construction of a driving circuit used in this embodiment. In this embodiment, the full-line multi-nozzle head is divided into n blocks $BL_1$ to $BL_n$ and these blocks are driven in a time-sharing manner. Later-mentioned signals SEL1, SEL2, LAT, Sck, STB, ECk, BE and CCK are input to predetermined input terminals of the respective blocks through common signal lines. A 7-bit signal for data entry and signal EI are input to the input terminals $D_o\phi_{-7}$ and $E_I$ of the block BL1 and are delivered from outlet terminals $D_o\phi_{-6}$ and $E_o$ to the input terminals $D_I\phi_{-7}$ and $E_I$ of the block BL2. The blocks are thus connected in cascade manner. $STB_I$ is an input terminal for receiving a signal STB which is set high for a period corresponding to the time for recording data of one page. The signal STB is input to the strobe gate 387. BEI is an input terminal which receives a signal BR which is set high during a period corresponding to the time required for recording of one-line data. EI is a signal which is used for setting a flip-flop 388 in each block in synchronization with a clock pulse ECK. $E_o$ is an output terminal for delivering an inverted output from the flip-flop 388 to the succeeding block.

In this embodiment, the output control of the counters CNTA and CNTB is performed by signals received through lines SEL1 and SEL2, while the counting clock CCK is supplied to both counters CNTA and CNTB through the input terminal CCKI. In operation, the 7-bit data are input to shift registers 310 to 312 from terminals $D_I\phi$ to $D_{I6}$, in synchronization with shift clocks from the terminal SckI, and a latch pulse LAT is delivered to a terminal LATI so as to set data as the set-up values of the counters CNTA and CNTB. In the illustrated embodiment, the counter CNTA has 3 bits, while the counter CNTB has 4 bits.

One of the blocks is selected when the flip-flop 388 therein has been set. In this state, a counter clock CCK is input to the terminal KI while the terminals SEL1 and SEL2 are receiving signals of high and low levels, respectively. Consequently, only the counter CNTA commenced up-counting, while the counter CNTB is not driven, so that a pulse of a width corresponding to the data set up in the counter CNTA is delivered to a driving switch device 385 through R gate 384 and a strobe gate 387, whereby the driving switch device 385 is controlled to open and close a circuit, so as to control the supply of the driving electrical power to an electrical-resistor (not shown) connected to the driving switch device 385, thereby effecting sub-heating.

Subsequently, a clock CCK is input to the terminal CCKI while the terminals SEL1 and SEL2 are receiving signals of low and high levels, respectively. In this case, only the counter CNTB is actuated so as to apply a second pulse for main heating.

By using a pair of counters CNTA and CNTB which function as two independent pulse generating means, it is possible to supply the electrical resistor with two pulses which are close to each other.

The illustrated modulation circuit,as described, features a counter which is provided in addition to an ordinary pulse width modulating counter and which controls the waveform of a sub-heat pulse. Conventionally, in order to attain high degree of uniformity of image density, a control is conducted to uniformalize the dot diameter over the entire image area. In this embodiment, unevenness of the recording density occurring in the direction of the sub-scan is achieved by effecting such a dot-diameter control in the-direction of the sub scan that the dot diameter is decreased in the image portion where the density is too high and dot diameter is increased in the image portion where the density is low, while maintaining uniformity of the dot diameter in the direction of the main scan.

The illustrated embodiment can be modified in various manners. For instance, a fine delicate image can be obtained by effecting a dot-diameter control in the direction of the main scan while conducting a driving-frequency control in the direction of the sub-scan.

Fourth Embodiment

Figure 18:
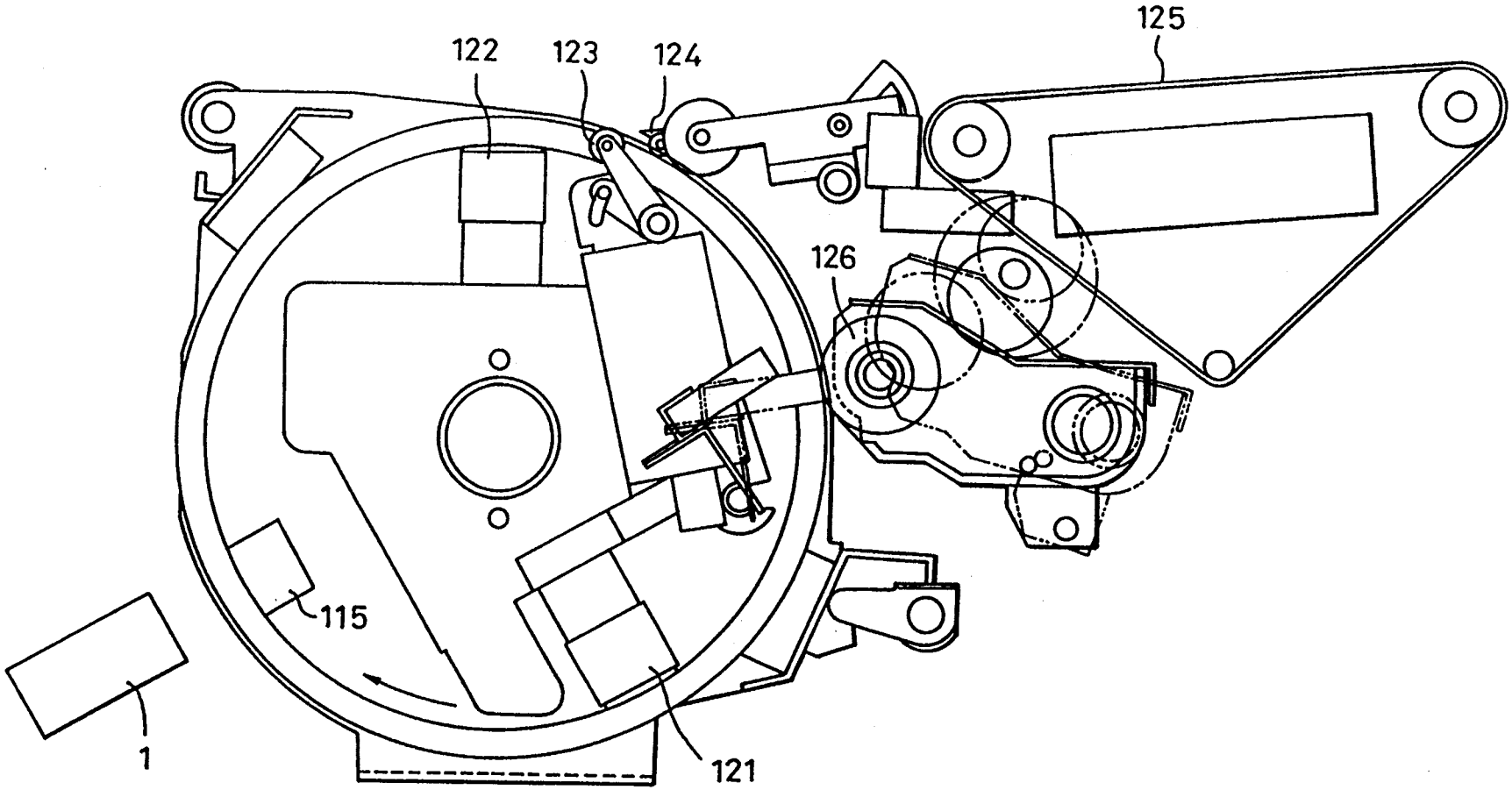
FIG. 18 is a sectional view of a recording drum to which the present invention is applied.

Although apparatuses having belt-type conveyor systems have been described, the present invention can equally be applied to apparatuses having other types of conveying system, e.g., a recording dry-type systems as shown in FIG. 18.

A recording medium such as a recording paper sheet is electrostatically attracted on the surface of a drum by the operation of an attracting charger 121. A print head 1 prints data on a portion of the recording medium which has been brought to a position between a platen 115 and the print head 1. Then, the printed portion of the recording medium is brought to a zone where a separation charger 122 is disposed so that the electrostatic attracting force is canceled. Then, the leading end of the recording medium is slightly lifted by a lifting roller 123 and is then separated from the drum by the effect of a separation claw 124. Thereafter, the recording medium is conveyed by a conveyor belt 125 so as to be ejected. The area of drum, which the recording medium has left, is then cleaned by a cleaner 126, thus completing one cycle of recording operation. In this system, the drum rotation speed is changed when the separation claw 124 is pressed and when the cleaner is put into operation, resulting in unevenness in the image quality. Such unevenness, however, can be eliminated substantially by the correcting methods such as the method relying upon the control of the manner of drive of the recording head and the method relying upon the digital image processing technique which are detailed in the foregoing description of embodiments.

The ink-jet recording systems mentioned in the foregoing description are of the type which forms and propels ink droplets by using thermal energy.

The construction and the principle of such ink-jet recording systems are preferably based upon those described in, for example, U.S. Pat. Nos. 4,723,129 and 4,740,796. The principle disclosed in these United States Patents can be realized both in on-demand type and continuous type apparatuses. The on-demand type apparatus has, in each of plural ink paths, an electro-thermal conversion element which exhibits a quick temperature rise to a level above the nucleate boiling temperature in response to at least one driving signal which is supplied in accordance with the information to be recorded. In response, film boiling of the ink is caused on the heating surface in the recording head, whereby one bubble or void is formed in the ink in response to one driving signal. Thus, in the on-demand type apparatus, generation of bubble or void can be controlled precisely by the number of the driving signals applied. The described correction methods of the present invention, therefore, can suitably be used in this type of recording apparatus. At least one droplet of the ink is generated and discharged from each discharge opening in response to growth and retraction of the bubble forming the void. Preferably, the driving signal is a pulse signal so that growth and retraction of the bubble can be controlled adequately and precisely to provide good response of the ink discharge.

Driving pulse signals as disclosed in U.S. Pat. Nos. 4,463,359 and 4,345,262 are suitably used as the driving pulses in the on-demand type apparatus. The recording quality will be further improved when the above-described ink discharging techniques are combined with conditions proposed in U.S. Pat. No. 4,313,124 which is directed to the rate of temperature rise of the heating surface of the recording head mentioned above.

The recording head suitably used in the present invention can be constructed by adopting various combinations of discharge openings, ink paths (straight or orthogonal) and electro-thermal conversion elements which are disclosed in the above-mentioned United States patents, as well as arrangements disclosed in U.S. Pat. Nos. 4,558,333 and 4,459,600 in which heating portions are disposed in curved regions of the ink paths or channels.

The recording head also may employ a structure disclosed in Japanese Laid-Open Patent Application No. 59-123670 in which a slit is used as a common outlet for a plurality of electro-thermal conversion elements, as well as a structure disclosed in Japanese Laid-Open Patent Application No. 59-138461 in which an opening for absorbing a pressure wave of the thermal energy is disposed corresponding to each discharge portion.

The full-line type recording head, which can span the width of the widest recording medium used with the recording apparatus, may be constructed by combining a plurality of recording heads of the described embodiments or may be an integral single recording head having a length corresponding to the above-mentioned width of the widest recording medium.

The recoding head also may be of replaceable chip type which, when mounted on the recording apparatus, automatically connects to the main part of the apparatus for the supply of electricity and ink, or of a cartridge type in which an ink tank is integrated with the recording head.

Provision of recovery means or preparatory means on the recording head is preferred because the use of such means stabilizes recording. Examples of such means are capping means, cleaning means, pressurizing or suction means, pre-heating means having an electro-thermal conversion element and/or a separate heating element, and a pre-purging means for performing non-recording discharging whenever necessary.

The recording mode of the recording apparatus is not limited to the recording in a principal color such as black but may be multi-color recording or full-color recording realized by color mixing. Such a multi-color or full-color recording mode may be realized by using an integral multi- or full-color recording head or an assembly of a plurality of recording heads for different colors.

In the foregoing description, the ink is described as being a liquid. This, however, is not exclusive. For instance, the ink may be solid at temperatures not higher than the room temperature, provided that it is softened or liquefied at higher temperatures. In the ink-jet recording system as described, it is an ordinary measure to adjust the ink temperature to a range between, for example, 30° C. and 70° C. so as to maintain the viscosity of the ink at a level suitable for jetting. The term "ink", therefore is to be understood to mean any ink which is in liquid state when used in printing in response to a recording signal.

The ink also maybe of a type which is liquefied only when a thermal energy is intentionally applied thereto. For instance, it is possible to use an ink which uses a latent heat as thermal energy for changing the phase from solid to liquid. It is also possible to use an ink which maintains its solid phase when not in use, so as not to evaporate. The ink may be usually solid and liquefied in response to thermal energy applied in accordance with the recording signal, so as to be discharged in liquid state, or may be of the type which stars to partially solidify when reaching the recording medium. When such types of ink are used, the ink may be retained in the liquid or solid phase within recesses or pores in a porous sheet of the types disclosed in Japanese Laid-Open Patent Application Nos. 54-56874 and 60-71260, the porous sheet being disposed so as to face the electro-thermal conversion element. Various types of ink mentioned above can be used most effectively when the invention is carried out in an ink jet recording system which relies upon film boiling as described before.

The image forming apparatus of the present invention can be used as an image output terminal integrated with or separate from an information processing machine such as a wordprocessor or a microcomputer, or may be combined with a reader so as to form a copying apparatus. The image forming apparatus of the invention also can be realized as the image forming section of a facsimile machine having a transmission/receiving function.

Fifth Embodiment

Although several types of ink jet recording apparatuses and printers are mentioned in the foregoing description, it is to be understood that the present invention can be applied to image forming systems of other types. A full-color electrophotographic copying apparatus of electrostatic drum transfer type will be described by way of example.

Figure 19:
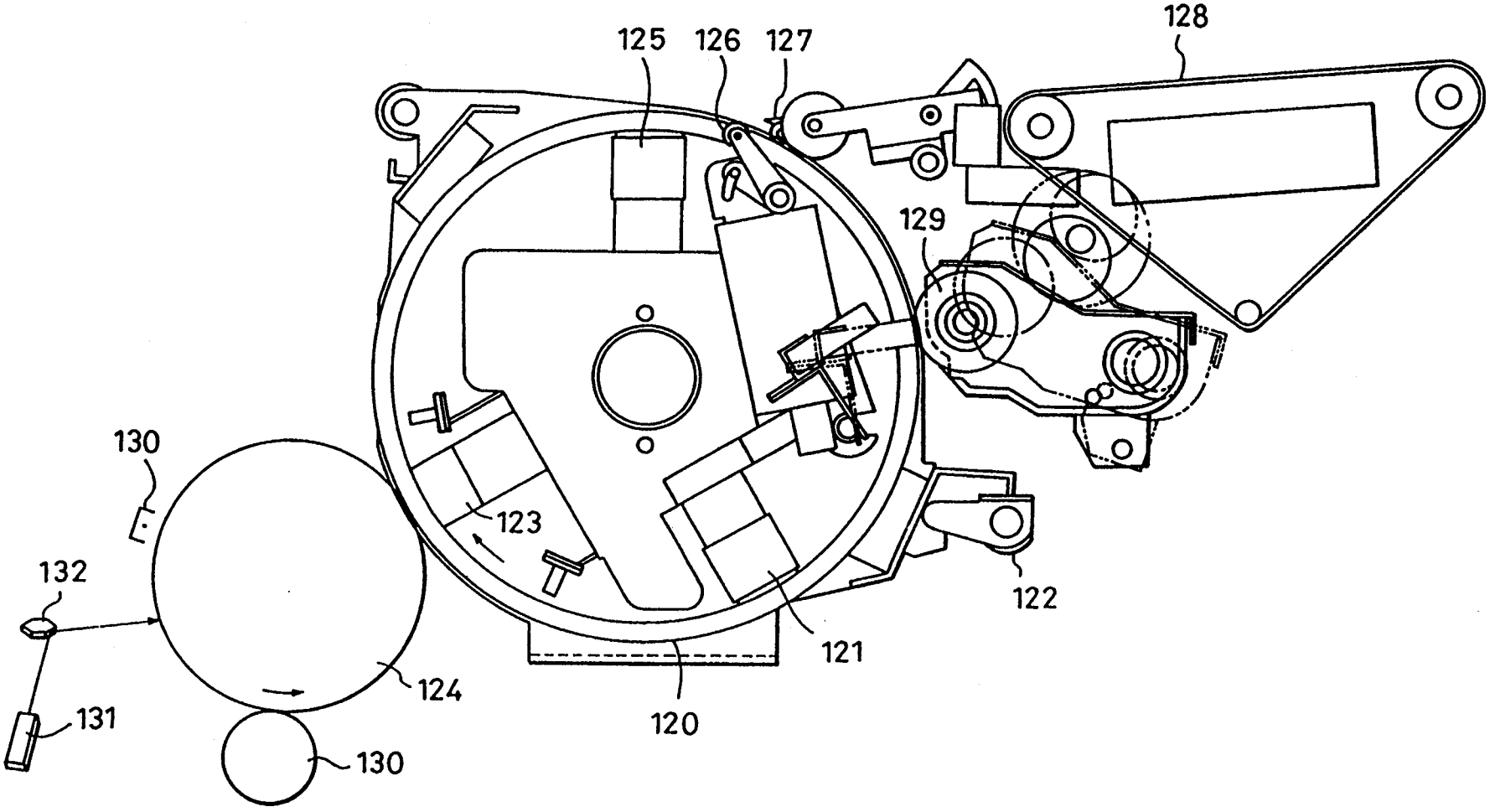
FIG. 19 is a sectional view of an electrophotographic color copying apparatus to which the present invention is applied.

FIG. 19 is a sectional view of a full-color copying apparatus to which the present invention is applied.

The copying apparatus has a photosensitive drum 129, a charger 130 for uniformly charging the surface of the photosensitive drum 129, a laser oscillator 131 which is modulated in accordance with image signals, a polygon mirror 132 for oscillating and deflecting the laser beam from the laser oscillator 131 in directions perpendicular to the direction of rotation of the photosensitive drum 129, and a developing device 133 for developing a latent image which has been formed on the surface of the photosensitive drum 129 by the deflected laser beam.

In operation, a recording medium such as a sheet of paper is fed through a feed guide 128 and is electrostatically attracted by a transfer sheet 127 on a transfer drum by the effect of a corona discharge from an attraction charger 121, and is conveyed by the transfer sheet 127. The image on the photosensitive drum 129 is transferred to the recording paper by the effect of a transfer charger 134. When the printing is to be conducted in four colors, e.g., M (magenta), C (cyan), Y (yellow) and Bk (Black), the photosensitive member rotates four times. After the completion of the transfer of four color images, the recording paper is separated from the drum by the actions of a separation charger 122 and a lifting roller 123 and is then separated from the drum and delivered to a fixing device. The drum from which the recording paper has been separated is cleaned by a cleaner 126 to prepare for the subsequent recording sequence. During the four-color recording sequence as described, different developing devices 133 for M, C, Y and Bk colors are repeatedly pressed against the photosensitive drum 129 so as to shock the same, which causes a vibration of the drum, resulting in unevenness of the recorded image. Modulation of the speeds of rotary members such as the photosensitive drum 129. The transfer drum and the polygon mirror 132 is impractical because it is not easy to precisely control the speed of such massive rotary parts. In the fifth embodiment of the invention, correction for the above-mentioned unevenness of recording is effected by controlling, in a pixel-by-pixel fashion, the threshold voltage of the laser oscillator 131 which determines the duration of the laser beam, so as to vary the recording energy in such a manner as to compensate for the unevenness of the recording density. Thus, in the fifth embodiment, greater recording energy is given during recording in a region where the recording density tends to become lower and vice versa, as in the case of the third embodiment described before. The individual components shown in outline or designated by blocks in the drawings are all well known in the photoelectric conversion and image apparatus arts,and their specific construction and operation is not critical to the operation or best mode for carrying out the invention.

As will be understood from the foregoing description, according to the present invention, it is possible to obtain a uniform recording quality over the entire area of the recording image, through elimination of any image unevenness which may occur in the direction of the sub-scan.

Although the invention has been described through its preferred forms, it is to be understood that the described embodiment is only illustrative and various changes and modifications may be imparted thereto without departing from the scope of the present invention which is limited solely by the appended claims.

What is claimed is:

1. An image forming apparatus including recording means for recording images on a recording medium in accordance with image signals, said apparatus comprising:

relative movement means for causing, after recording in a main scan direction by said recording means, relative movement between said recording means and the recording medium in a sub-scan direction which is different from the main scan direction; and control means for effecting a correction of recording density unevenness caused by a variation in a speed of said relative movement means, by controlling said recording means in accordance with the variation in the speed of said relative movement means, wherein said control means includes memory means for storing data concerning a deviation of a recording position of said recording means relative to a relative position of the recording medium, and reads out, during the relative movement, the stored data from said memory means in accordance with the relative movement between the recording medium and said recording means, to control said recording means in accordance with the stored data.

2. An image forming apparatus according to claim 1, wherein said control means controls a driving frequency of said recording means to effect correction of recording density unevenness.

3. An image forming apparatus according to claim 1, wherein said control means corrects the image signals so as to control the recording density in the sub-scan direction so as to effect correction for the recording density unevenness.

4. An image forming apparatus according to claim 1, wherein said control means records by forming recording dots on the recording medium in response to driving signals and said control means corrects the driving signals so as to control diameters of the recording dots, to thereby effect correction for the recording density unevenness.

5. An image forming apparatus according to claim 4, wherein the driving signal are in the form of driving pulses and said control means controls the diameters of the recording dots by controlling widths of the driving pulses.

6. An image forming apparatus according to one of claim 1, wherein said recording means comprises a plurality of recording elements arranged linearly in the main scan direction for a length corresponding to a width of the recording medium.

7. An image forming apparatus according to claim 2, wherein said recording means comprises a plurality of recording elements arranged linearly in the main scan direction for a length corresponding to a width of the recording medium.

8. An image forming apparatus according to claim 3, wherein said recording means comprises a plurality of recording elements arranged linearly in the main scan direction for a length corresponding to a width of the recording medium.

9. An image forming apparatus according to claim 4, wherein said recording means comprises a plurality of recording elements arranged linearly in the main scan direction for a length corresponding to a width of the recording medium.

10. An image forming apparatus according to claim 5, wherein said recording means comprises a plurality of recording elements arranged linearly in the main scan direction for a length corresponding to a width of the recording medium.

11. An image forming apparatus according to claim 6, wherein each recording element comprises an energy generating element which generates energy to cause a change in the state of ink in said recording means, thereby causing the ink to be discharged from a discharge opening in said recording means.

12. An image forming apparatus according to claim 7, wherein each of said recording elements comprises an energy generating element which generates energy to cause a change in the state of ink in said recording means, thereby causing the ink to be discharged from a discharge opening in said recording means.

13. An image forming apparatus according to claim 8, wherein each of said recording elements comprises an energy generating element which generates energy to cause a change in the state of ink in said recording means, thereby causing the ink to be discharged from a discharge opening in said recording means.

14. An image forming apparatus according to claim 9, wherein each of said recording elements comprises an energy generating element which generates energy to cause a change in the state of ink in said recording means, thereby causing the ink to be discharged from a discharge opening in said recording means.

15. An image forming apparatus according to claim 10, wherein each of said recording elements comprises an energy generating element which generates energy to cause a change in the state of ink in said recording means, thereby causing the ink to be discharged from a discharge opening in said recording means.

16. An image forming apparatus according to claim 11, wherein each of said energy generating elements comprises a thermal energy generating element.

17. An image forming apparatus according to claim 12, wherein each of said energy generating elements comprises a thermal energy generating element.

18. An image forming apparatus according to claim 13, wherein each of said energy generating elements comprises a thermal energy generating element.

19. An image forming apparatus according to claim 14, wherein each of said energy generating elements comprises a thermal energy generating element.

20. An image forming apparatus according to claim 15, wherein each of said energy generating elements comprises a thermal energy generating element.

21. An image forming apparatus comprising:

recording means scanningly movable in a raster scan direction for recording an image on a recording medium in each raster scan;

relative movement means for causing relative movement between said recording means and the recording medium at a relative speed in a sub-scan direction substantially perpendicular to the raster scan direction; and control means for controlling said recording means in accordance with any change in the relative speed of movement between said recording means and the recording medium in the sub-scan direction, wherein said control means includes memory means for storing data concerning a deviation of a recording position of said recording means relative to a relative position of the recording medium, and reads out, during the relative movement, the stored data from said memory means in accordance with the relative movement between the recording medium and said recording means to control said recording means in accordance with the stored data.

22. An image forming apparatus according to claim 21, wherein said recording means comprises a laser beam generator, and forms an electrostatic latent image on the recording medium using a laser beam generated by said laser beam generator.

23. An image forming apparatus according to claim 22, wherein said control means controls a threshold voltage for generation of the laser beam by said laser beam generator.

24. An image forming apparatus including recording means for recording dot images on a recording medium in accordance with image signals, said apparatus comprising:

relative movement means for causing relative movement between said recording means and the recording medium in a sub-scan direction which is different from a main scan direction of said recording means;

memory means for storing at a concerning a variation in a speed of said relative movement means; and control means for effecting a correction of recording density unevenness caused by the variation in the speed of said relative movement means, by reading out, during the relative movement, the stored data from said memory means in accordance with the relative movement between the recording medium and said recording means to control a number of print dots per area recorded by said recording means in accordance with the stored data.

25. An image forming apparatus according to claim 24, wherein the data stored in said memory means concerns a deviation of a recording position of said recording means relative to a relative position of the recording medium during the relative movement.

26. An image forming apparatus according to claim 24 or 25, wherein said control means controls the number of the print dots per area in the sub-scan direction by correcting the image signals.

27. An image forming apparatus according to claim 24 or 25, wherein said recording means comprises a plurality of recording elements arranged linearly in the main scan direction for a length corresponding to a width of the recording medium.

28. An image forming apparatus according to claim 27, wherein each of said recording elements comprises an energy generating element which generates energy to cause a change in state of ink in said recording means, thereby causing the ink to be discharged from a discharge opening in said recording means.

29. An image forming apparatus according to claim 28, wherein each of said energy generating elements comprises a thermal energy generating element.

30. An image forming apparatus according to claim 26, wherein said recording means comprises a plurality of recording elements arranged linearly in the main scan direction for a length corresponding to the recording medium.

31. An image forming apparatus according to claim 30, wherein each of said recording elements comprises an energy generating element which generates energy to cause a change in state of ink in said recording means, thereby causing the ink to be discharged from a discharge opening in said recording means.

32. An image forming apparatus according to claim 31, wherein each of said energy generating elements comprises a thermal energy generating element.

33. An image forming apparatus including recording means for recording images on a recording medium in accordance with image signals, said apparatus comprising:

relative movement means for causing, after recording in a main scan direction by said recording means, relative movement between said recording means and the recording medium in a sub-scan direction which is different from the main scan direction;

memory means for storing data concerning a variation in a speed of said relative movement means; and control means for effecting correction of recording density unevenness caused by the variation in the speed of said relative movement means, by reading out, during the relative movement, the stored data from said memory mean in accordance with the relative movement of the recording medium and said recording means to control a driving frequency of said recording means in accordance with the stored data.

34. An image forming apparatus according to claim 33, wherein the data stored in said memory means concerns a deviation of a recording position of said recording means relative to a relative position of the recording medium during the relative movement.

35. An image forming apparatus according to claim 33 or 34, wherein said recording means comprises a plurality of recording elements arranged linearly in the main scan direction for a length corresponding to a width of the recording medium.

36. An image forming apparatus according to claim 35, wherein each of said recording elements comprises an energy generating element which generates energy to cause a change in the state of ink in said recording means, thereby causing the ink to be discharged from a discharge opening in said recording means.

37. An image forming apparatus to claim 36, wherein each of said energy generating elements comprises a thermal energy generating element.

38. An image forming apparatus including recording means for recording dot images on a recording medium in accordance with image signals, said apparatus comprising:

relative movement means for causing, after recording in a main scan direction by said recording means, relative movement between said recording means and the recording medium in a sub-scan direction which is different from the main scan direction;

memory means for storing data concerning a variation in a speed of said relative movement means; and control means for effecting a correction of recording density unevenness caused by the variation in the speed of said relative movement means, by reading out, during the relative movement, the stored data from said memory means in accordance with the relative position of the recording medium to control a diameter of the recording dot recorded by said recording means in accordance with the stored data.

39. An image forming apparatus according to claim 38, wherein the data stored in said memory means concerns a deviation of a recording position of said recording means relative to a relative position of the recording medium during the relative movement.

40. An image forming apparatus according to claim 38 or 39, wherein said recording means comprises a plurality of recording elements arranged linearly in the main scan direction for a length corresponding to a width of the recording medium.

41. An image forming apparatus according to claim 40, wherein each of said recording elements comprises an energy generating element which generates energy to cause a change in the state of ink in said recording means, thereby causing the ink to be discharged from a discharge opening in said recording means.

42. An image forming apparatus according to claim 41, wherein each of said energy generating elements comprises a thermal energy generating element.

* * * * *

UNITED STATES PATENT AND TRADEMARK OFFICE

CERTIFICATE OF CORRECTION

PATENT NO. : 5,444,468

DATED : August 22, 1995

INVENTOR(S) : Hisashi FUKUSHIMA, et al.

It is certified that error appears in the above-indentified patent and that said Letters Patent is hereby corrected as shown below:

AT [56] - REFERENCES CITED - FOREIGN PATENT DOCUMENTS:

"0132473 5/1990 Japan ." should read --2-0132473 5/1990 Japan .--.

AT [57] - ABSTRACT:

Line 10, "cause" should read --caused--;
Line 11, "movements" should read --movement--.

COLUMN 1:

Line 60, "quality,through" should read --quality, through--.

COLUMN 2:

Line 30, "ah" should read --an--.

COLUMN 3:

Line 38, "position," should read --position--.

COLUMN 4:

Line 35, "operation,the" should read --operation, the--.

UNITED STATES PATENT AND TRADEMARK OFFICE

CERTIFICATE OF CORRECTION

PATENT NO. : 5,444,468

DATED : August 22, 1995

INVENTOR(S) : Hisashi FUKUSHIMA, et al.

It is certified that error appears in the above-indentified patent and that said Letters Patent is hereby corrected as shown below:

COLUMN 6:

Line 57, "convey" should read --conveyance--.

COLUMN 7:

Line 5, "convey" should read --conveyance--.

COLUMN 11:

Line 19, "employs,as" should read --employs, as--.

COLUMN 12:

Line 8, "$D_O\phi_{-7}$" should read --$D_I\phi_{-7}$--;
Line 57, "circuit,as" should read --circuit, as--.

COLUMN 15:

Line 1, "maybe" should read --may be--.

COLUMN 16:

Line 7, "129." should read --129,--;
Line 8, "The" should read --the--;

UNITED STATES PATENT AND TRADEMARK OFFICE

CERTIFICATE OF CORRECTION

PATENT NO. : 5,444,468

DATED : August 22, 1995

INVENTOR(S) : Hisashi FUKUSHIMA, et al.

It is certified that error appears in the above-indentified patent and that said Letters Patent is hereby corrected as shown below:

COLUMN 17:

Line 14, "signal" should read --signals--;
Line 18, "one of" should be deleted.

Signed and Sealed this

Thirtieth Day of January, 1996

Attest:

Bruce Lehman

BRUCE LEHMAN

Attesting Officer

Commissioner of Patents and Trademarks